US008428484B2

(12) United States Patent
Plewnia et al.

(10) Patent No.: US 8,428,484 B2
(45) Date of Patent: Apr. 23, 2013

(54) METHODS AND SYSTEMS FOR PERIPHERAL ACCOUNTING

(75) Inventors: Boguslaw Ludwik Plewnia, Mission Viejo, CA (US); Shinichi Yamamura, Irvine, CA (US); Hanzhong Zhang, Cypress, CA (US); David J. Lovat, Huntington Beach, CA (US); Amarender Reddy Kethl Reddy, Fountain Valley, CA (US); Roy K. Chrisop, Camas, WA (US); Tanna Richardson, Portland, OR (US); Uoc Nguyen, Long Beach, CA (US); Joey Lum, Irvine, CA (US); Mark Liu Stevens, Laguna Hills, CA (US)

(73) Assignee: Sharp Laboratories of America, Inc., Camas, WA (US)

( * ) Notice: Subject to any disclaimer, the term of this patent is extended or adjusted under 35 U.S.C. 154(b) by 652 days.

(21) Appl. No.: 11/073,055

(22) Filed: Mar. 4, 2005

(65) Prior Publication Data

US 2006/0198653 A1 Sep. 7, 2006

(51) Int. Cl.
*G03G 21/02* (2006.01)

(52) U.S. Cl.
USPC ..... 399/79; 399/80; 399/81; 358/1.13; 358/1.14; 358/1.15; 358/1.16; 715/741; 715/742; 715/743; 726/4; 726/27; 726/28; 726/29; 726/30

(58) Field of Classification Search ..... 358/1.9, 358/1.13, 1.15, 1.14, 1.16; 713/182; 726/27, 726/2, 3, 4, 5, 6, 7, 8, 17, 19, 21, 28, 29, 726/30; 715/701, 710, 740, 741, 742, 743; 399/79, 80, 81
See application file for complete search history.

(56) References Cited

U.S. PATENT DOCUMENTS

| | | | |
|---|---|---|---|
| 5,085,587 | A | 2/1992 | DesForges et al. |
| 5,228,100 | A | 7/1993 | Takeda et al. |
| 5,323,393 | A | 6/1994 | Barrett et al. |
| 5,365,494 | A | 11/1994 | Lynch |
| 5,410,646 | A | 4/1995 | Tondeviod et al. |
| 5,504,589 | A | 4/1996 | Montague et al. |
| 5,513,112 | A | 4/1996 | Herring et al. |
| 5,542,031 | A | 7/1996 | Douglass et al. |
| 5,586,260 | A | 12/1996 | Hu |
| 5,659,845 | A | 8/1997 | Krist et al. |
| 5,664,206 | A | 9/1997 | Murow et al. |
| 5,671,412 | A | 9/1997 | Christiano |

(Continued)

FOREIGN PATENT DOCUMENTS

| | | |
|---|---|---|
| EP | 1160657 | 12/2001 |
| JP | 09160441 | 12/1995 |

(Continued)

OTHER PUBLICATIONS

Ratha, N.K., Connell, J.H., Bolle, R.M. "Enhancing security and privacy in biometrics-based authentication systems". IBM Systems Journal 40(3), pp. 614-634 (2001).

(Continued)

*Primary Examiner* — Vu B Hang
(74) *Attorney, Agent, or Firm* — Krieger Intellectual Property, Inc.; Scott C. Krieger

(57) ABSTRACT

Embodiments of the present invention comprise systems, methods and devices for providing external accounting functions for a peripheral device.

3 Claims, 15 Drawing Sheets

U.S. PATENT DOCUMENTS

| | | | |
|---|---|---|---|
| 5,699,493 | A | 12/1997 | Davidson et al. |
| 5,699,494 | A | 12/1997 | Colbert et al. |
| 5,717,439 | A | 2/1998 | Levine et al. |
| 5,726,883 | A | 3/1998 | Levine et al. |
| 5,727,082 | A | 3/1998 | Sugishima |
| 5,727,135 | A | 3/1998 | Webb et al. |
| 5,745,712 | A | 4/1998 | Turpin et al. |
| 5,745,883 | A | 4/1998 | Krist et al. |
| 5,760,775 | A | 6/1998 | Sklut et al. |
| 5,774,678 | A | 6/1998 | Motoyama |
| 5,778,356 | A | 7/1998 | Heiny |
| 5,791,790 | A | 8/1998 | Bender et al. |
| 5,796,934 | A | 8/1998 | Bhanot et al. |
| 5,799,206 | A | 8/1998 | Kitagawa et al. |
| 5,799,289 | A | 8/1998 | Fukushima et al. |
| 5,812,818 | A | 9/1998 | Adler et al. |
| 5,832,264 | A | 11/1998 | Hart et al. |
| 5,848,231 | A | 12/1998 | Teitelbaum et al. |
| 5,877,776 | A | 3/1999 | Beaman et al. |
| 5,915,001 | A | 6/1999 | Uppaluru |
| 5,944,824 | A | 8/1999 | He |
| 5,956,487 | A | 9/1999 | Venkatraman et al. |
| 5,956,698 | A | 9/1999 | Lacheze et al. |
| 5,968,127 | A | 10/1999 | Kawabe et al. |
| 5,993,088 | A | 11/1999 | Nogay et al. |
| 5,995,553 | A | 11/1999 | Crandall et al. |
| 5,999,708 | A | 12/1999 | Kajita |
| 6,042,384 | A | 3/2000 | Loiacono |
| 6,044,382 | A | 3/2000 | Martino |
| 6,069,706 | A | 5/2000 | Kajita |
| 6,075,860 | A | 6/2000 | Ketcham |
| 6,115,132 | A | 9/2000 | Nakasuma et al. |
| 6,118,546 | A | 9/2000 | Sanchez |
| 6,128,731 | A | 10/2000 | Zarrin et al. |
| 6,141,662 | A | 10/2000 | Jeyachandran |
| 6,148,346 | A | 11/2000 | Hanson |
| 6,161,139 | A | 12/2000 | Win et al. |
| 6,178,308 | B1 | 1/2001 | Bobrow et al. |
| 6,199,080 | B1 | 3/2001 | Nielsen |
| 6,213,652 | B1 | 4/2001 | Suzuki et al. |
| 6,216,113 | B1 | 4/2001 | Aikens et al. |
| 6,233,409 | B1 | 5/2001 | Haines et al. |
| 6,239,802 | B1 | 5/2001 | Lahey et al. |
| 6,240,456 | B1 | 5/2001 | Teng et al. |
| 6,246,487 | B1 | 6/2001 | Kobayashi |
| 6,292,267 | B1 | 9/2001 | Mori et al. |
| 6,301,016 | B1 | 10/2001 | Matsueda et al. |
| 6,307,640 | B1 | 10/2001 | Motegi |
| 6,311,040 | B1 | 10/2001 | Kucinski et al. |
| 6,349,275 | B1 | 2/2002 | Schumacher et al. |
| 6,353,878 | B1 | 3/2002 | Dunham |
| 6,369,905 | B1 | 4/2002 | Mitsuhashi et al. |
| 6,407,820 | B1 | 6/2002 | Hansen et al. |
| 6,426,798 | B1 | 7/2002 | Yeung |
| 6,433,883 | B1 | 8/2002 | Kajita |
| 6,438,589 | B1 | 8/2002 | Iwata |
| 6,462,756 | B1 | 10/2002 | Hansen et al. |
| 6,476,926 | B1 | 11/2002 | Yano et al. |
| 6,490,547 | B1 | 12/2002 | Atkin et al. |
| 6,490,601 | B1 | 12/2002 | Markus et al. |
| 6,509,974 | B1 | 1/2003 | Hansen |
| 6,510,466 | B1 | 1/2003 | Cox et al. |
| 6,516,157 | B1 | 2/2003 | Maruta et al. |
| 6,526,258 | B2 | 2/2003 | Bejar et al. |
| 6,567,179 | B1 | 5/2003 | Sato et al. |
| 6,590,589 | B1 | 7/2003 | Sluiman |
| 6,590,673 | B2 | 7/2003 | Kadowaki |
| 6,592,275 | B1 | 7/2003 | Aihara et al. |
| 6,597,469 | B1 | 7/2003 | Kuroyanagi |
| 6,604,157 | B1 | 8/2003 | Brusky et al. |
| 6,621,422 | B2 | 9/2003 | Rubenstein |
| 6,623,529 | B1 | 9/2003 | Lakritz |
| 6,636,929 | B1 | 10/2003 | Frantz et al. |
| 6,643,650 | B1 | 11/2003 | Slaughter et al. |
| 6,652,169 | B2 | 11/2003 | Parry |
| 6,685,637 | B1 | 2/2004 | Rom |
| 6,707,466 | B1 | 3/2004 | Van Sickle et al. |
| 6,721,286 | B1 | 4/2004 | Williams et al. |
| 6,735,773 | B1 | 5/2004 | Trinh et al. |
| 6,749,434 | B2 | 6/2004 | Stuppy |
| 6,775,729 | B1 | 8/2004 | Matsuo et al. |
| 6,772,945 | B2 | 10/2004 | Mahoney et al. |
| 6,823,225 | B1 | 11/2004 | Sass |
| 6,826,727 | B1 | 11/2004 | Mohr et al. |
| 6,836,623 | B2 | 12/2004 | Imai |
| 6,836,845 | B1 | 12/2004 | Lennie et al. |
| 6,850,252 | B1 | 2/2005 | Hoffberg |
| 6,854,839 | B2 | 2/2005 | Collier et al. |
| 6,862,110 | B2 | 3/2005 | Harrington |
| 6,862,583 | B1 | 3/2005 | Mazzagatte et al. |
| 6,865,716 | B1 | 3/2005 | Thurston |
| 6,873,429 | B2 | 3/2005 | Matsuura |
| 6,874,010 | B1 | 3/2005 | Sargent |
| 6,904,412 | B1 | 6/2005 | Broadbent et al. |
| 6,915,525 | B2 | 7/2005 | Ozawa |
| 6,934,706 | B1 | 8/2005 | Mancuso et al. |
| 6,934,740 | B1 | 8/2005 | Lawande et al. |
| 6,940,532 | B1 | 9/2005 | Fukui et al. |
| 6,948,175 | B1 | 9/2005 | Fong et al. |
| 6,951,303 | B2 | 10/2005 | Petersen et al. |
| 6,964,014 | B1 | 11/2005 | Parish |
| 6,975,820 | B2 | 12/2005 | Wong |
| 6,999,987 | B1 | 2/2006 | Billingsley et al. |
| 7,003,723 | B1 | 2/2006 | Kremer et al. |
| 7,007,026 | B2 | 2/2006 | Wilkinson et al. |
| 7,012,706 | B1 | 3/2006 | Hansen |
| 7,013,289 | B2 | 3/2006 | Horn et al. |
| 7,019,753 | B2 | 3/2006 | Rappaport et al. |
| 7,034,958 | B1 | 4/2006 | Hara |
| 7,072,057 | B1 | 7/2006 | Hansen |
| 7,079,143 | B2 | 7/2006 | Gilbert |
| 7,095,513 | B2 | 8/2006 | Stringham |
| 7,107,285 | B2 | 9/2006 | von Kaenel et al. |
| 7,107,615 | B2 | 9/2006 | Cossel et al. |
| 7,117,504 | B2 | 10/2006 | Smith et al. |
| 7,124,097 | B2 | 10/2006 | Claremont et al. |
| 7,126,717 | B2 | 10/2006 | Jeyachandran |
| 7,127,700 | B2 | 10/2006 | Large |
| 7,136,909 | B2 | 11/2006 | Balasuriya |
| 7,136,941 | B2 | 11/2006 | Nguyen et al. |
| 7,143,364 | B1 | 11/2006 | Tam |
| 7,145,673 | B1 * | 12/2006 | Lin ..... 358/1.15 |
| 7,145,686 | B2 | 12/2006 | Simpson et al. |
| 7,149,697 | B2 | 12/2006 | Zerza et al. |
| 7,149,964 | B1 | 12/2006 | Cottrille et al. |
| 7,162,103 | B2 | 1/2007 | Meunier et al. |
| 7,170,618 | B2 | 1/2007 | Fujitani et al. |
| 7,171,615 | B2 | 1/2007 | Jensen et al. |
| 7,174,056 | B2 | 2/2007 | Silverbrook et al. |
| 7,177,814 | B2 | 2/2007 | Gong et al. |
| 7,181,017 | B1 | 2/2007 | Nagel et al. |
| 7,181,442 | B2 | 2/2007 | Yeh et al. |
| 7,185,078 | B2 | 2/2007 | Pleyer et al. |
| 7,188,125 | B1 | 3/2007 | Karr |
| 7,188,181 | B1 | 3/2007 | Squier et al. |
| 7,191,391 | B2 | 3/2007 | Takashima |
| 7,191,393 | B1 | 3/2007 | Chin et al. |
| 7,197,615 | B2 | 3/2007 | Arakawa et al. |
| 7,203,699 | B2 | 4/2007 | Bellamy |
| 7,212,301 | B2 | 5/2007 | Treibach-Heck et al. |
| 7,216,292 | B1 | 5/2007 | Snapper et al. |
| 7,216,347 | B1 | 5/2007 | Harrison et al. |
| 7,228,501 | B2 | 6/2007 | Brown et al. |
| 7,233,929 | B1 | 6/2007 | Lingle et al. |
| 7,233,973 | B2 | 6/2007 | Melet et al. |
| 7,234,110 | B2 | 6/2007 | Sumitomo |
| 7,239,409 | B2 | 7/2007 | Parry |
| 7,249,100 | B2 | 7/2007 | Murto et al. |
| RE39,808 | E | 9/2007 | Motegi |
| 7,268,896 | B2 | 9/2007 | Bellagamba et al. |
| 7,272,269 | B2 | 9/2007 | Tojo et al. |
| 7,275,044 | B2 | 9/2007 | Chauvin et al. |
| 7,284,061 | B2 | 10/2007 | Matsubayashi et al. |
| 7,284,199 | B2 | 10/2007 | Parasnis et al. |
| 7,293,034 | B2 | 11/2007 | Paya et al. |
| 7,296,221 | B1 | 11/2007 | Treibach-Heck et al. |
| 7,301,658 | B2 | 11/2007 | Henry |

7,305,616 B1 12/2007 Nelson et al.
7,313,587 B1 12/2007 Dharmarajan
7,321,440 B2 * 1/2008 Kimura ..... 358/1.15
7,325,196 B1 1/2008 Covington et al.
7,327,478 B2 2/2008 Matsuda
7,328,245 B1 2/2008 Hull et al.
7,340,389 B2 3/2008 Vargas
7,343,551 B1 3/2008 Bourdev
7,349,949 B1 3/2008 Connor et al.
7,363,586 B1 4/2008 Briggs et al.
7,397,362 B2 7/2008 Zhang et al.
7,404,204 B2 7/2008 Davenport et al.
7,406,660 B1 7/2008 Sikchi et al.
7,412,374 B1 8/2008 Seiler et al.
7,424,129 B2 9/2008 Hull et al.
7,437,406 B2 10/2008 Hauduc et al.
7,437,663 B2 10/2008 Lakhdhir et al.
7,441,188 B1 10/2008 Russell et al.
7,444,519 B2 10/2008 Laferriere et al.
7,444,590 B2 10/2008 Christian et al.
7,451,117 B2 11/2008 Cozianu et al.
7,451,392 B1 11/2008 Chalecki et al.
7,454,623 B2 11/2008 Hardt
7,467,211 B1 12/2008 Herman et al.
7,472,343 B2 12/2008 Vasey
7,478,171 B2 1/2009 Ramaswamy et al.
7,490,167 B2 2/2009 Pena et al.
7,496,837 B1 2/2009 Larcheveque et al.
7,500,178 B1 3/2009 O'Donnell
7,508,535 B2 3/2009 Hart et al.
7,509,649 B2 3/2009 Shenfield
7,545,528 B2 6/2009 Takabayashi et al.
7,548,334 B2 6/2009 Lo et al.
7,552,265 B2 6/2009 Newman et al.
7,565,554 B2 7/2009 Joosten et al.
7,567,360 B2 7/2009 Takahashi et al.
7,573,593 B2 8/2009 Hart et al.
7,599,942 B1 10/2009 Mohamad
7,657,557 B2 2/2010 Super
7,729,363 B2 6/2010 Shenfield et al.
7,826,081 B2 11/2010 Stevens et al.
7,886,219 B2 2/2011 Lund
7,904,600 B2 3/2011 Madril et al.
7,920,101 B2 4/2011 Lum et al.
7,941,743 B2 5/2011 Reddy et al.
7,941,744 B2 5/2011 Oppenlander et al.
7,975,214 B2 7/2011 Boegelund et al.
8,006,176 B2 8/2011 Reddy et al.
8,037,402 B2 10/2011 Foushee et al.
8,049,677 B2 11/2011 Lum et al.
8,060,556 B2 11/2011 Krane et al.
2001/0021945 A1 9/2001 Matsuura
2001/0027439 A1 10/2001 Holzman et al.
2001/0027527 A1 10/2001 Khidekel et al.
2001/0028808 A1 10/2001 Nomura et al.
2001/0038462 A1 11/2001 Teeuwen et al.
2001/0039614 A1 11/2001 Hellberg et al.
2001/0044787 A1 11/2001 Shwartz et al.
2002/0016921 A1 2/2002 Olsen et al.
2002/0020750 A1 2/2002 Dymetman et al.
2002/0029256 A1 3/2002 Zintel et al.
2002/0032745 A1 3/2002 Honda
2002/0049786 A1 4/2002 Bibliowicz et al.
2002/0052916 A1 5/2002 Kloba et al.
2002/0055984 A1 5/2002 Chang et al.
2002/0059265 A1 5/2002 Valorose, III
2002/0073148 A1 6/2002 Haines et al.
2002/0080381 A1 6/2002 Haines
2002/0089691 A1 7/2002 Ferlitsch et al.
2002/0093676 A1 7/2002 Parry
2002/0098027 A1 7/2002 Koike et al.
2002/0099796 A1 7/2002 Chou
2002/0103827 A1 8/2002 Sesek
2002/0105664 A1 8/2002 Inoue et al.
2002/0107939 A1 8/2002 Ford et al.
2002/0109718 A1 8/2002 Mansour et al.
2002/0112037 A1 8/2002 Koss
2002/0120792 A1 8/2002 Blair
2002/0138279 A1 9/2002 Al-Kazily et al.
2002/0138476 A1 9/2002 Suwa et al.
2002/0138666 A1 9/2002 Fujisawa
2002/0145627 A1 10/2002 Whitmarsh
2002/0147858 A1 10/2002 Motoyama et al.
2002/0152183 A1 10/2002 Soares et al.
2002/0152235 A1 10/2002 Motoyama et al.
2002/0152302 A1 10/2002 Motoyama et al.
2002/0156688 A1 10/2002 Horn et al.
2002/0156795 A1 10/2002 Edwards et al.
2002/0156846 A1 10/2002 Rawat et al.
2002/0171857 A1 11/2002 Hisatomi
2002/0194180 A1 12/2002 Alsop et al.
2002/0194350 A1 12/2002 Lu et al.
2003/0002074 A1 1/2003 Miyano
2003/0007170 A1 1/2003 Kajita et al.
2003/0011633 A1 1/2003 Conley et al.
2003/0011640 A1 1/2003 Green et al.
2003/0014515 A1 1/2003 Motoyama et al.
2003/0014529 A1 1/2003 Simpson et al.
2003/0033369 A1 2/2003 Bernhard
2003/0035133 A1 2/2003 Berkema et al.
2003/0038965 A1 2/2003 Simpson et al.
2003/0043205 A1 3/2003 Hill
2003/0043396 A1 3/2003 Klosterman et al.
2003/0043405 A1 3/2003 Hill
2003/0048470 A1 3/2003 Garcia
2003/0048473 A1 3/2003 Rosen
2003/0049037 A1 3/2003 Sadowara et al.
2003/0053123 A1 3/2003 Wu et al.
2003/0063313 A1 4/2003 Ito
2003/0065766 A1 4/2003 Parry
2003/0065791 A1 4/2003 Garg et al.
2003/0065985 A1 4/2003 McGeorge, Jr.
2003/0074267 A1 4/2003 Acharya et al.
2003/0074312 A1 4/2003 White
2003/0081240 A1 5/2003 Soto et al.
2003/0084114 A1 5/2003 Simpson et al.
2003/0084302 A1 5/2003 de Jong et al.
2003/0088642 A1 5/2003 Price et al.
2003/0106021 A1 6/2003 Mangrola
2003/0123112 A1 7/2003 Kajita et al.
2003/0131110 A1 7/2003 Chang et al.
2003/0140053 A1 7/2003 Vasey
2003/0142351 A1 7/2003 Sakura
2003/0164987 A1 9/2003 Enomoto et al.
2003/0167336 A1 9/2003 Iwamoto et al.
2003/0174356 A1 9/2003 Cherry et al.
2003/0182632 A1 9/2003 Murdock et al.
2003/0184552 A1 10/2003 Chadha
2003/0184590 A1 10/2003 Will
2003/0184782 A1 10/2003 Perkins
2003/0187922 A1 10/2003 Ohara et al.
2003/0188193 A1 10/2003 Venkataramappa
2003/0188260 A1 10/2003 Jensen et al.
2003/0197883 A1 10/2003 Lay et al.
2003/0212982 A1 11/2003 Brooks et al.
2003/0225796 A1 12/2003 Matsubara
2003/0225829 A1 12/2003 Pena et al.
2003/0225894 A1 12/2003 Ito
2003/0231196 A1 12/2003 Keohane et al.
2003/0233437 A1 12/2003 Kitada et al.
2004/0003341 A1 1/2004 alSafadi et al.
2004/0008363 A1 1/2004 Suzuki et al.
2004/0012628 A1 1/2004 Kropf et al.
2004/0012644 A1 1/2004 Allen et al.
2004/0019705 A1 1/2004 Ogura
2004/0030693 A1 2/2004 Toda
2004/0034786 A1 * 2/2004 Okamoto et al. ..... 713/189
2004/0034807 A1 2/2004 Rostowfske
2004/0039990 A1 2/2004 Bakar et al.
2004/0044779 A1 3/2004 Lambert
2004/0046789 A1 3/2004 Inanoria
2004/0054573 A1 3/2004 Shah et al.
2004/0061729 A1 4/2004 Green
2004/0064759 A1 4/2004 McGuire et al.
2004/0068693 A1 4/2004 Rawat et al.
2004/0070606 A1 4/2004 Yang et al.
2004/0080511 A1 4/2004 Gilbert
2004/0080771 A1 4/2004 Mihira et al.

2004/0080778 A1 4/2004 Ito et al.
2004/0088155 A1 5/2004 Kerr et al.
2004/0093515 A1 5/2004 Reeves, Jr.
2004/0098165 A1 5/2004 Butikofer
2004/0098316 A1 5/2004 Philippe et al.
2004/0098595 A1 5/2004 Apperle et al.
2004/0105104 A1 6/2004 Ishikawa et al.
2004/0105122 A1 6/2004 Schaeffer
2004/0109028 A1 6/2004 Stern et al.
2004/0111670 A1 6/2004 Sasakuma et al.
2004/0113941 A1 6/2004 Sliwa et al.
2004/0117358 A1 6/2004 von Kaenel et al.
2004/0117784 A1 6/2004 Endoh
2004/0122659 A1 6/2004 Hourihane et al.
2004/0125403 A1 7/2004 Furst et al.
2004/0128349 A1 7/2004 Maruyama
2004/0130744 A1 7/2004 Wu et al.
2004/0130749 A1 7/2004 Aoki
2004/0133525 A1 7/2004 Singh et al.
2004/0150663 A1 8/2004 Kim
2004/0158471 A1 8/2004 Davis et al.
2004/0162076 A1 8/2004 Chowdry et al.
2004/0165209 A1 8/2004 Aoki et al.
2004/0169881 A1 9/2004 Sato
2004/0179229 A1 9/2004 Laughlin
2004/0181747 A1 9/2004 Hull et al.
2004/0187018 A1 9/2004 Owen et al.
2004/0193678 A1 9/2004 Trufinescu et al.
2004/0161257 A1 10/2004 Ishihara
2004/0199538 A1 10/2004 Matsuda et al.
2004/0203358 A1 10/2004 Anderson et al.
2004/0205118 A1 10/2004 Yu
2004/0205533 A1 10/2004 Lopata et al.
2004/0205620 A1 10/2004 Nishikiori et al.
2004/0212823 A1 10/2004 Chavers et al.
2004/0215671 A1 10/2004 Hyakutake et al.
2004/0221231 A1 11/2004 Madril, Jr. et al.
2004/0223778 A1 11/2004 Zwiefelhofer
2004/0226993 A1 11/2004 Fulcher et al.
2004/0227968 A1 11/2004 Nakamura et al.
2004/0230500 A1 11/2004 Imago
2004/0230637 A1 11/2004 Lecoueche et al.
2004/0236862 A1 11/2004 Ito
2004/0254955 A1 12/2004 Reese et al.
2004/0255263 A1 12/2004 Ando
2004/0261010 A1 12/2004 Matsuishi
2004/0268229 A1 12/2004 Paoli et al.
2004/0268306 A1 12/2004 Cheng et al.
2005/0005094 A1 1/2005 Jamieson et al.
2005/0015472 A1 1/2005 Catania et al.
2005/0015585 A1 1/2005 Kurose
2005/0022112 A1 1/2005 Kato
2005/0026593 A1 2/2005 Anderson et al.
2005/0028086 A1 2/2005 Itavaara et al.
2005/0044248 A1 2/2005 Mihira et al.
2005/0055475 A1 3/2005 MacKay et al.
2005/0057560 A1 3/2005 Bibr et al.
2005/0060046 A1 3/2005 Ito et al.
2005/0060564 A1 3/2005 Murakami et al.
2005/0063010 A1 3/2005 Giannetti
2005/0068581 A1 3/2005 Hull et al.
2005/0071507 A1 3/2005 Ferlitsch
2005/0071746 A1 3/2005 Hart et al.
2005/0076291 A1 4/2005 Yee et al.
2005/0080649 A1 4/2005 Alvarez et al.
2005/0086584 A1 4/2005 Sampathkumar et al.
2005/0091087 A1 4/2005 Smith et al.
2005/0091490 A1 4/2005 Ogura
2005/0091671 A1 4/2005 Deem et al.
2005/0097458 A1 5/2005 Wilson
2005/0102616 A1 5/2005 Thurston
2005/0108353 A1 5/2005 Yamamoto
2005/0114267 A1 5/2005 Miwa et al.
2005/0114658 A1 5/2005 Dye et al.
2005/0114766 A1 5/2005 Yamamoto
2005/0119955 A1 6/2005 Dang et al.
2005/0129423 A1 6/2005 Lester et al.
2005/0131715 A1 6/2005 Trethewey
2005/0138547 A1 6/2005 Muhanna et al.
2005/0149576 A1 7/2005 Marmaros et al.
2005/0152334 A1 7/2005 Okamoto et al.
2005/0185217 A1* 8/2005 Nishizawa et al. ..... 358/1.15
2005/0195221 A1 9/2005 Berger et al.
2005/0203747 A1 9/2005 Lecoeuche
2005/0210399 A1 9/2005 Filner et al.
2005/0223413 A1 10/2005 Duggan et al.
2005/0231747 A1 10/2005 Bledsoe et al.
2005/0231755 A1 10/2005 Araumi et al.
2005/0246428 A1 11/2005 Araumi
2005/0257134 A1 11/2005 Goodman et al.
2005/0257148 A1 11/2005 Goodman et al.
2005/0262440 A1 11/2005 Stanciu et al.
2005/0265744 A1 12/2005 Uruta
2006/0004738 A1 1/2006 Blackwell et al.
2006/0007480 A1 1/2006 Yokokura
2006/0010180 A1 1/2006 Kawamura et al.
2006/0015734 A1 1/2006 Atobe
2006/0028397 A1 2/2006 O'Rourke
2006/0031411 A1 2/2006 Gimson et al.
2006/0038004 A1 2/2006 Rielly et al.
2006/0041443 A1 2/2006 Horvath, Jr.
2006/0045386 A1 3/2006 Fukuoka et al.
2006/0056873 A1 3/2006 Kimura
2006/0059434 A1 3/2006 Boss et al.
2006/0064647 A1 3/2006 Tapuska et al.
2006/0075251 A1* 4/2006 Correl et al. ..... 713/182
2006/0077119 A1 4/2006 Zhang et al.
2006/0077411 A1 4/2006 Mathieson et al.
2006/0077413 A1 4/2006 Lum et al.
2006/0077414 A1 4/2006 Lum et al.
2006/0077426 A1 4/2006 Lovat et al.
2006/0077427 A1 4/2006 Zhang et al.
2006/0077428 A1 4/2006 Lovat et al.
2006/0077429 A1 4/2006 Zhang et al.
2006/0077430 A1 4/2006 Zhang et al.
2006/0077431 A1 4/2006 Zhang et al.
2006/0077432 A1 4/2006 Lovat et al.
2006/0077433 A1 4/2006 Zhang et al.
2006/0077434 A1 4/2006 Zhang et al.
2006/0077435 A1 4/2006 Lovat et al.
2006/0077436 A1 4/2006 Zhang et al.
2006/0077437 A1 4/2006 Lovat et al.
2006/0077438 A1 4/2006 Lovat et al.
2006/0077439 A1 4/2006 Yamamura et al.
2006/0077440 A1 4/2006 Stevens et al.
2006/0077442 A1 4/2006 Lum et al.
2006/0077443 A1 4/2006 Lum et al.
2006/0077444 A1 4/2006 Lum et al.
2006/0077445 A1 4/2006 Yamamura et al.
2006/0077446 A1 4/2006 Lum et al.
2006/0077447 A1 4/2006 Sojian et al.
2006/0077448 A1 4/2006 Plewnia et al.
2006/0077449 A1 4/2006 Lum et al.
2006/0077450 A1 4/2006 Reddy et al.
2006/0077451 A1 4/2006 Nguyen et al.
2006/0077452 A1 4/2006 Nguyen et al.
2006/0077453 A1 4/2006 Plewnia et al.
2006/0077454 A1 4/2006 Lum et al.
2006/0078345 A1 4/2006 Lovat et al.
2006/0078346 A1 4/2006 Lovat et al.
2006/0080123 A1 4/2006 Plewnia
2006/0080124 A1 4/2006 Plewnia
2006/0080129 A1 4/2006 Reddy et al.
2006/0080184 A1 4/2006 Zhang et al.
2006/0080185 A1 4/2006 Lovat et al.
2006/0080731 A1 4/2006 Zhang et al.
2006/0085430 A1 4/2006 Yamamura et al.
2006/0085835 A1 4/2006 Istvan et al.
2006/0086788 A1 4/2006 Zhang et al.
2006/0090128 A1 4/2006 Reddy et al.
2006/0077423 A1 5/2006 Mathieson et al.
2006/0092097 A1 5/2006 Reddy et al.
2006/0095541 A1 5/2006 Sojian et al.
2006/0095542 A1 5/2006 Reddy et al.
2006/0103588 A1 5/2006 Chrisop et al.
2006/0103873 A1 5/2006 Reddy et al.
2006/0107197 A1 5/2006 Friend et al.
2006/0107212 A1 5/2006 Lovat et al.

| | | | |
|---|---|---|---|
| 2006/0107224 | A1 | 5/2006 | Friend et al. |
| 2006/0112123 | A1 | 5/2006 | Clark et al. |
| 2006/0117257 | A1 | 6/2006 | Hasson et al. |
| 2006/0119883 | A1 | 6/2006 | Lovat et al. |
| 2006/0154227 | A1 | 7/2006 | Rossi et al. |
| 2006/0162076 | A1 | 7/2006 | Bartlett et al. |
| 2006/0165105 | A1 | 7/2006 | Shenfield et al. |
| 2006/0168355 | A1 | 7/2006 | Shenfield et al. |
| 2006/0174196 | A1 | 8/2006 | Zhang et al. |
| 2006/0184522 | A1 | 8/2006 | McFarland et al. |
| 2006/0200748 | A1 | 9/2006 | Shenfield |
| 2006/0200749 | A1 | 9/2006 | Shenfield |
| 2006/0221941 | A1 | 10/2006 | Kishinsky et al. |
| 2006/0224405 | A1 | 10/2006 | White et al. |
| 2006/0235742 | A1 | 10/2006 | Castellanos et al. |
| 2006/0277286 | A1 | 12/2006 | Zhang et al. |
| 2006/0279474 | A1 | 12/2006 | Lum et al. |
| 2006/0279475 | A1 | 12/2006 | Lum et al. |
| 2007/0022180 | A1 | 2/2007 | Shu et al. |
| 2007/0041035 | A1 | 2/2007 | Sembower et al. |
| 2007/0061129 | A1 | 3/2007 | Barreiro |
| 2007/0078805 | A1 | 4/2007 | Reddy et al. |
| 2007/0089049 | A1 | 4/2007 | Gormish et al. |
| 2007/0091010 | A1 | 4/2007 | Richardson et al. |
| 2007/0094103 | A1 | 4/2007 | Hyakutake et al. |
| 2007/0146823 | A1 | 6/2007 | Borchers et al. |
| 2007/0147610 | A1 | 6/2007 | Kethi Reddy |
| 2007/0173266 | A1 | 7/2007 | Barnes |
| 2007/0174894 | A1 | 7/2007 | Matsunaga |
| 2007/0186150 | A1 | 8/2007 | Rao et al. |
| 2007/0201654 | A1 | 8/2007 | Shenfield |
| 2007/0201655 | A1 | 8/2007 | Shenfield |
| 2007/0226608 | A1 | 9/2007 | Virk et al. |
| 2007/0233902 | A1 | 10/2007 | Trefler et al. |
| 2007/0283274 | A1 | 12/2007 | Mettifogo |
| 2007/0291293 | A1 | 12/2007 | Bellagamba et al. |
| 2008/0022267 | A1 | 1/2008 | Johnson et al. |
| 2008/0046806 | A1 | 2/2008 | Reddy et al. |
| 2008/0072162 | A1 | 3/2008 | Dauerer et al. |
| 2008/0155396 | A1 | 6/2008 | Dubinko et al. |
| 2008/0162116 | A1 | 7/2008 | Briggs et al. |

FOREIGN PATENT DOCUMENTS

| | | | |
|---|---|---|---|
| JP | 08234945 | | 9/1996 |
| JP | O9293036 | | 11/1997 |
| JP | O9330190 | | 12/1997 |
| JP | 10013695 | | 1/1998 |
| JP | 10154190 | A | 6/1998 |
| JP | 10240490 | | 9/1998 |
| JP | 10269184 | | 10/1998 |
| JP | 2000112691 | | 4/2000 |
| JP | 2000174949 | | 6/2000 |
| JP | 2000207108 | | 7/2000 |
| JP | 2002259071 | | 2/2001 |
| JP | 2001268296 | | 9/2001 |
| JP | 200284383 | | 3/2002 |
| JP | 2002140195 | | 5/2002 |
| JP | 2002171380 | | 6/2002 |
| JP | 2002175195 | | 6/2002 |
| JP | 2002221877 | | 8/2002 |
| JP | 2002236830 | | 8/2002 |
| JP | 2002298049 | A | 10/2002 |
| JP | 2002312148 | | 10/2002 |
| JP | 2002324049 | | 11/2002 |
| JP | 2002330253 | | 11/2002 |
| JP | 2002351644 | | 12/2002 |
| JP | 2003022258 | | 1/2003 |
| JP | 2003050781 | | 2/2003 |
| JP | 2003157155 | A | 5/2003 |
| JP | 2003178023 | | 6/2003 |
| JP | 2003196554 | A | 7/2003 |
| JP | 2003198792 | | 7/2003 |
| JP | 2003208484 | | 7/2003 |
| JP | 2003209644 | | 7/2003 |
| JP | 2003216368 | | 7/2003 |
| JP | 2003216395 | A | 7/2003 |
| JP | 2003223299 | | 8/2003 |
| JP | 2003260853 | | 9/2003 |
| JP | 2003281227 | | 10/2003 |
| JP | 2003288179 | | 10/2003 |
| JP | 2003308195 | | 10/2003 |
| JP | 200430448 | | 1/2004 |
| JP | 2004074530 | | 3/2004 |
| JP | 2004088561 | | 3/2004 |
| JP | 2004094313 | | 3/2004 |
| JP | 2004128561 | | 4/2004 |
| JP | 2004118549 | | 5/2004 |
| JP | 2004164157 | A | 6/2004 |
| JP | 2004185396 | | 7/2004 |
| JP | 2004213356 | | 7/2004 |
| JP | 2004215309 | | 7/2004 |
| JP | 2004222247 | | 8/2004 |
| JP | 2004228686 | | 8/2004 |
| JP | 2004228687 | | 8/2004 |
| JP | 2004240752 | | 8/2004 |
| JP | 2004246771 | | 9/2004 |
| JP | 2004310326 | | 11/2004 |
| JP | 2004310516 | | 11/2004 |
| JP | 2004276271 | | 12/2004 |
| JP | 2004358800 | | 12/2004 |
| JP | 2005014591 | | 1/2005 |
| JP | 2005033460 | | 2/2005 |
| JP | 2005059496 | | 3/2005 |
| JP | 2005070979 | | 3/2005 |
| JP | 2005078278 | | 3/2005 |
| JP | 2005084891 | | 3/2005 |
| JP | 2005115543 | | 4/2005 |
| JP | 2005004243 | | 6/2005 |
| JP | 2005209059 | | 8/2005 |
| JP | 2005219440 | A | 8/2005 |
| JP | 2005235034 | A | 9/2005 |
| JP | 2005269250 | | 9/2005 |
| JP | 2006053905 | | 2/2006 |
| JP | 2006140898 | | 6/2006 |
| WO | WO0118754 | A1 | 3/2001 |
| WO | WO01/33381 | | 5/2001 |
| WO | WO0198864 | | 12/2001 |

OTHER PUBLICATIONS

U.S. Appl. No. 10/962,248—Final Office Action dated Jun. 10, 2009.
U.S. Appl. No. 10/962,248—Non-Final Office Action dated Jan. 29, 2010.
U.S. Appl. No. 11/232,588—Non-Final Office Action dated Apr. 1, 2009.
U.S. Appl. No. 11/232,588—Final Office Action dated Nov. 27, 2009.
U.S. Appl. No. 10/961,793—Non-Final Office Action dated Jun. 24, 2009.
U.S. Appl. No. 10/961,793—Final Office Action dated Feb. 4, 2010.
U.S. Appl. No. 10/961,911—Non-Final Office Action dated Jun. 8, 2009.
U.S. Appl. No. 10/961,911—Non-Final Office Action dated Feb. 3, 2010.
U.S. Appl. No. 10/962,103—Non-Final Office Action dated Aug. 14, 2009.
U.S. Appl. No. 11/232,827—Final Office Action dated Jun. 4, 2009.
U.S. Appl. No. 11/232,827—Non-Final Office Action dated Dec. 1, 2009.
U.S. Appl. No. 11/233,202—Non-Final Office Action dated Jun. 9, 2009.
U.S. Appl. No. 11/233,202—Final Office Action dated Jan. 15, 2010.
U.S. Appl. No. 11/233,201—Final Office Action dated Apr. 28, 2009.
U.S. Appl. No. 11/233,201—Non-Final Office Action dated Sep. 4, 2009.
U.S. Appl. No. 11/232,552—Final Office Action dated Jun. 24, 2009.
U.S. Appl. No. 11/232,552—Non-Final Office Action dated Dec. 24, 2009.
U.S. Appl. No. 11/233,270—Final Office Action dated Mar. 31, 2009.
U.S. Appl. No. 11/233,270—Final Office Action dated Nov. 27, 2009.
U.S. Appl. No. 11/465,699—Non-Final Office Action dated Sep. 17, 2008.

U.S. Appl. No. 11/465,699—Final Office Action dated Mar. 31, 2009.
U.S. Appl. No. 11/465,699—Final Office Action dated Nov. 27, 2009.
U.S. Appl. No. 11/465,722—Non-Final Office Action dated Dec. 24, 2009.
U.S. Appl. No. 11/241,501—Final Office Action dated May 13, 2009.
U.S. Appl. No. 11/241,501—Non-Final Office Action dated Feb. 9, 2010.
U.S. Appl. No. 11/241,497—Non-Final Office Action dated Oct. 6, 2009.
U.S. Appl. No. 11/241,011—Final Office Action dated Apr. 2, 2009.
U.S. Appl. No. 11/241,011—Non-Final Office Action dated Jan. 4, 2010.
U.S. Appl. No. 11/241,010—Final Office Action dated Mar. 20, 2009.
U.S. Appl. No. 11/241,071—Non-Final Office Action dated Aug. 19, 2009.
U.S. Appl. No. 11/241,447—Non-Final Office Action dated Jul. 22, 2009.
U.S. Appl. No. 11/241,498—Non-Final Office Action dated Dec. 10, 2009.
U.S. Appl. No. 11/240,039—Final Office Action dated Apr. 13, 2009.
U.S. Appl. No. 11/240,039—Non-Final Office Action dated Nov. 3, 2009.
U.S. Appl. No. 11/240,156—Non-Final Office Action dated Sep. 16, 2009.
U.S. Appl. No. 11/255,611—Notice of Allowance dated Aug. 10, 2009.
U.S. Appl. No. 11/256,479—Final Office Action dated Apr. 1, 2009.
U.S. Appl. No. 11/256,479—Non-Final Office Action dated Nov. 16, 2009.
U.S. Appl. No. 11/192,617—Non-Final Office Action dated Sep. 29, 2009.
U.S. Appl. No. 11/193,154—Non-Final Office Action dated Jun. 3, 2009.
U.S. Appl. No. 11/193,154—Final Office Action dated Dec. 7, 2009.
U.S. Appl. No. 11/192,630—Final Office Action dated Sep. 2, 2009.
U.S. Appl. No. 11/192,546—Final Office Action dated Jun. 30, 2009.
U.S. Appl. No. 11/192,546—Non-Final Office Action dated Nov. 24, 2009.
U.S. Appl. No. 11/193,077—Notice of Allowance dated Mar. 11, 2008.
U.S. Appl. No. 11/192,870—Non-Final Office Action dated Jul. 17, 2009.
U.S. Appl. No. 11/192,870—Final Office Action dated Jan. 4, 2010.
U.S. Appl. No. 11/192,865—Non-Final Office Action dated Aug. 20, 2009.
U.S. Appl. No. 11/192,836—Notice of Allowance dated Dec. 30, 2008.
U.S. Appl. No. 11/192,616—Non-Final Office Action dated Sep. 17, 2009.
U.S. Appl. No. 11/193,147—Notice of Allowance dated Dec. 30, 2008.
U.S. Appl. No. 11/192,868—Final Office Action dated Aug. 11, 2009.
U.S. Appl. No. 11/192,629—Final Office Action dated Jun. 26, 2009.
U.S. Appl. No. 11/192,629—Non-Final Office Action dated Jan. 15, 2010.
U.S. Appl. No. 11/193,151—Final Office Action dated Sep. 21, 2009.
U.S. Appl. No. 11/193,188—Final Office Action dated Aug. 5, 2009.
U.S. Appl. No. 11/192,824—Non-Final Office Action dated Sep. 18, 2009.
U.S. Appl. No. 11/193,140—Final Office Action dated May 18, 2009.
U.S. Appl. No. 11/193,140—Notice of Allowance dated Jan. 29, 2010.
U.S. Appl. No. 11/192,796—Non-Final Office Action dated Dec. 28, 2009.
U.S. Appl. No. 11/192,615—Non-Final Office Action dated Sep. 4, 2009.
U.S. Appl. No. 11/192,547—Final Office Action dated Jan. 15, 2010.
U.S. Appl. No. 11/192,467—Non-Final Office Action dated Nov. 13, 2009.
U.S. Appl. No. 11/255,333—Notice of Allowance dated Nov. 3, 2009.
U.S. Appl. No. 11/465,747—Non-Final Office Action dated Jun. 24, 2009.
U.S. Appl. No. 11/465,752—Non-Final Office Action dated Jun. 24, 2009.
U.S. Appl. No. 11/241,320—Non-Final Office Action dated Oct. 7, 2009.
U.S. Appl. No. 11/240,139—Non-Final Office Action dated Oct. 6, 2009.
U.S. Appl. No. 11/240,084—Final Office Action dated Apr. 15, 2009.
U.S. Appl. No. 11/240,084—Non-Final Office Action dated Dec. 16, 2009.
U.S. Appl. No. 11/218,033—Final Office Action dated Mar. 30, 2009.
U.S. Appl. No. 11/218,033—Non-Final Office Action dated Sep. 8, 2009.
U.S. Appl. No. 11/218,186—Non-Final Office Action dated Jun. 23, 2009.
U.S. Appl. No. 11/218,186—Final Office Action dated Feb. 1, 2010.
U.S. Appl. No. 11/562,342—Non-Final Office Action dated May 29, 2009.
U.S. Appl. No. 11/562,342—Final Office Action dated Dec. 21, 2009.
U.S. Appl. No. 11/685,046—Non-Final Office Action dated Jul. 8, 2009.
U.S. Appl. No. 11/685,046—Final Office Action dated Dec. 21, 2009.
JP Patent App. No. 2006-261563—Office Action filed for a related foreign application dated Jan. 19, 2010.
JP Patent App. No. 2006-207199—Office Action filed for a related foreign application dated Feb. 2, 2010.
JP Patent App. No. 2006-058600—Office Action filed for a related foreign application dated Aug. 18, 2009.
JP Patent App. No. 2005-295772—Office Action filed for a related foreign application dated Sep. 15, 2009.
JP Patent App. No. 2005-295772—Notice of Allowance filed for a related foreign application dated Dec. 15, 2009.
JP Patent App. No. 2006-207200—Office Action filed for a related foreign application dated Feb. 2, 2010.
JP Patent App. No. 2006-207194—Office Action filed for a related foreign application dated Jan. 12, 2010.
JP Patent App. No. 2006-261564—Office Action filed for a related foreign application dated Jan. 19, 2010.
JP Patent App. No. 2006-207199—Office Action filed for a related foreign application dated Nov. 17, 2009.
JP Patent App. No. 2007-225913—Office Action filed for a related foreign application dated Dec. 24, 2009.
JP Patent App. No. 2006-256442—Office Action filed for a related foreign application dated Jul. 14, 2009.
JP Patent App. No. 2006-207194—Office Action filed for a related foreign application dated Jun. 23, 2009.
F.D. Wright, Design Goals for an Internet Printing Protocol, Apr. 1999, pp. 1-43, http://tools.ietf.org/html/rfc2567.
R. Herriot, Internet Printing Protocol (IPP): Event Notifications and Subscriptions (Feb. 21, 2003, retrieved from http://tools.ietf.org/html/draft-ietf-ipp-not-spec-11 on Aug. 20, 2008, pp. 1-101).
T. Hastings, "Internet Printing Protocol/1.1: Model and Semantics" (Sep. 2000, retrieved from http://www.ietf.org/rfc/rfc291.txt on Sep. 18, 2008, pp. 1-210).
R. Herriot, Internet Printing Protocol (IPP): Event Notifications and Subscriptions, Jun. 21, 2004, http://tools.ietf.org/html/draft-ietf-ipp-not-spec-12, pp. 1-98.
Microsoft Corporation. Microsoft Computer Dictionary, Fifth Edition, 2002 Microsoft Press, pp. 487-488.
Gaedke, Martin et al. "A Modeling Approach to Federated Identity and Access Management", May 2005 ACM.
FOLDOC. "relational database", Jun. 2002, retrieved from <http://foldoc.org/index.cgi?query=relational+database>.

OASIS. "Security Assertion Markup Language (SAML) 2.0 Technical Overview", Working Draft 01, Jul. 22, 2004, <http://www.oasis-open.org/committees/documents.php?wg_abbrev=security>.
Hartman, Bret et al. Mastering Web Services Security, 2003 Wiley Publishing, Inc., pp. 36-46.
U.S. Appl. No. 10/962,248—Office Action dated Aug. 19, 2008.
U.S. Appl. No. 10/961,793—Office Action dated Jun. 20, 2008.
U.S. Appl. No. 10/961,793—Office Action dated Dec. 19, 2008.
U.S. Appl. No. 10/961,911—Office Action dated Oct. 28, 2008.
U.S. Appl. No. 10/961,594—Office Action dated Dec. 3, 2008.
U.S. Appl. No. 10/961,594—Office Action dated Mar. 16, 2009.
U.S. Appl. No. 10/962,103—Office Action dated Jul. 9, 2008.
U.S. Appl. No. 10/962,103—Office Action dated Jan. 23, 2009.
U.S. Appl. No. 11/232,827—Office Action dated Dec. 5, 2008.
U.S. Appl. No. 11/233,202—Office Action dated Jun. 5, 2008.
U.S. Appl. No. 11/233,202—Office Action dated Dec. 1, 2008.
U.S. Appl. No. 11/233,201—Office Action dated Oct. 3, 2008.
U.S. Appl. No. 11/232,552—Office Action dated Nov. 18, 2008.
U.S. Appl. No. 11/233,270—Office Action dated Sep. 17, 2008.
U.S. Appl. No. 11/241,501—Office Action dated Oct. 23, 2008.
U.S. Appl. No. 11/241,497—Office Action dated Feb. 20, 2009.
U.S. Appl. No. 11/241,497—Office Action dated Aug. 27, 2008.
U.S. Appl. No. 11/241,011—Office Action dated Oct. 8, 2008.
U.S. Appl. No. 11/241,010—Office Action dated Oct. 9, 2008.
U.S. Appl. No. 11/241,071—Office Action dated Mar. 3, 2009.
U.S. Appl. No. 11/241,071—Office Action dated Sep. 19, 2008.
U.S. Appl. No. 11/241,447—Office Action dated Mar. 5, 2009.
U.S. Appl. No. 11/241,447—Office Action dated Sep. 15, 2008.
U.S. Appl. No. 11/241,498—Office Action dated Sep. 16, 2008.
U.S. Appl. No. 11/241,498—Office Action dated Mar. 5, 2009.
U.S. Appl. No. 11/240,039—Office Action dated Oct. 20, 2008.
U.S. Appl. No. 11/240,156—Office Action dated Aug. 28, 2008.
U.S. Appl. No. 11/240,156—Office Action dated Feb. 20, 2009.
U.S. Appl. No. 11/255,611—Office Action dated Mar. 12, 2009.
U.S. Appl. No. 11/256,479—Office Action dated Nov. 4, 2008.
U.S. Appl. No. 11/255,333—Office Action dated Mar. 13, 2009.
U.S. Appl. No. 11/193,154—Office Action dated Dec. 2, 2008.
U.S. Appl. No. 11/192,630—Office Action dated Jan. 21, 2009.
U.S. Appl. No. 11/192,546—Office Action dated Jan. 22, 2009.
U.S. Appl. No. 11/192,836—Office Action dated Jul. 9, 2008.
U.S. Appl. No. 11/193,147—Office Action dated Jul. 9, 2008.
U.S. Appl. No. 11/192,868—Office Action dated Feb. 2, 2009.
U.S. Appl. No. 11/192,629—Office Action dated Jan. 22, 2009.
U.S. Appl. No. 11/193,151—Office Action dated Feb. 23, 2009.
U.S. Appl. No. 11/193,188—Office Action dated Jan. 21, 2009.
U.S. Appl. No. 11/193,140—Office Action dated Nov. 18, 2008.
U.S. Appl. No. 11/192,796—Office Action dated Feb. 24, 2009.
U.S. Appl. No. 11/192,547—Office Action dated Feb. 5, 2009.
U.S. Appl. No. 11/240,084—Office Action dated Oct. 30, 2008.
U.S. Appl. No. 11/218,033—Office Action dated Sep. 12, 2008.
U.S. Appl. No. 10/961,911—Office Action dated Apr. 16, 2008.
U.S. Appl. No. 10/961,594—Office Action dated Jan. 7, 2008.
U.S. Appl. No. 11/193,077—Office Action dated Apr. 6, 2007.
U.S. Appl. No. 11/192,836—Office Action dated Dec. 5, 2007.
U.S. Appl. No. 11/192,836—Office Action dated Jul. 3, 2007.
U.S. Appl. No. 11/192,836—Office Action dated Jan. 30, 2007.
U.S. Appl. No. 11/193,147—Office Action dated Dec. 6, 2007.
U.S. Appl. No. 11/193,147—Office Action dated Jul. 23, 2007.
U.S. Appl. No. 11/193,147—Office Action dated Feb. 9, 2007.
Foreign Patent App. No. JP2006-058600—Office Action filed for a related foreign application dated Aug. 18, 2009 corresponding to U.S. Appl. No. 11/073,055.
Foreign Patent App. No. JP2006-207200—Office Action filed for a related foreign application dated Jun. 1, 2010 corresponding to U.S. Appl. No. 11/192,547.
Foreign Patent App. No. JP2006-207196—Office Action filed for a related foreign application dated Mar. 2, 2010 corresponding to U.S. Appl. No. 11/192,862.
Foreign Patent App. No. JP2006-256441—Office Action filed for a related foreign application dated Mar. 30, 2010 corresponding to U.S. Appl. No. 11/233,202.
Foreign Patent App. No. JP2006-207198—Office Action filed for a related foreign application dated Mar. 2, 2010 corresponding to U.S. Appl. No. 11/192,616.
U.S. Appl. No. 10/961,594—Final Office Action dated Apr. 2, 2010.
U.S. Appl. No. 10/962,103—Non-final Office Action dated May 14, 2010.
U.S. Appl. No. 11/232,827—Final Office Action dated Jun. 14, 2010.
U.S. Appl. No. 11/233,201—Final Office Action dated Jun. 3, 2010.
U.S. Appl. No. 11/232,588—Notice of Allowance dated Jun. 23, 2010.
U.S. Appl. No. 11/233,270—Non-final Office Action dated Jun. 9, 2010.
U.S. Appl. No. 11/465,699—Non-final Office Action dated Nov. 16, 2009.
U.S. Appl. No. 11/465,699—Final Office Action dated May 24, 2010.
U.S. Appl. No. 11/465,722—Final Office Action dated Apr. 30, 2010.
U.S. Appl. No. 11/241,011—Final Office Action dated Jun. 29, 2010.
U.S. Appl. No. 11/241,010—Non-final Office Action dated Apr. 15, 2010.
U.S. Appl. No. 11/241,071—Final Office Action dated Apr. 16, 2010.
U.S. Appl. No. 11/241,447—Final Office Action dated Apr. 1, 2010.
U.S. Appl. No. 11/240,039—Notice of Allowance dated Jun. 3, 2010.
U.S. Appl. No. 11/240,156—Final Office Action dated Mar. 31, 2010.
U.S. Appl. No. 11/256,479—Final Office Action dated May 13, 2010.
U.S. Appl. No. 11/192,617—Final Office Action dated Jun. 11, 2010.
U.S. Appl. No. 11/193,076—Non-final Office Action dated Apr. 5, 2010.
U.S. Appl. No. 11/192,630—Non-final Office Action dated Apr. 9, 2010.
U.S. Appl. No. 11/192,546—Final Office Action dated Jul. 14, 2010.
U.S. Appl. No. 11/192,937—First Action Interview Pilot Program Pre-Interview Communication dated Apr. 7, 2010.
U.S. Appl. No. 11/192,616—Final Office Action dated May 26, 2010.
U.S. Appl. No. 11/192,500—Non-final Office Action dated Jul. 21, 2010.
U.S. Appl. No. 11/192,868—Non-final Office Action dated May 19, 2010.
U.S. Appl. No. 11/193,188—Non-final Office Action dated Apr. 19, 2010.
U.S. Appl. No. 11/192,824—Non-final Office Action dated Mar. 1, 2010.
U.S. Appl. No. 11/192,615—Final Office Action dated Apr. 20, 2010.
U.S. Appl. No. 11/192,547—Non-final Office Action dated Jun. 25, 2010.
U.S. Appl. No. 11/192,467—Final Office Action dated Jun. 25, 2010.
U.S. Appl. No. 11/256,493—Non-final Office Action dated Mar. 9, 2010.
U.S. Appl. No. 11/465,752—Final Office Action dated Apr. 2, 2010.
U.S. Appl. No. 11/241,320—Final Office Action dated Jun. 17, 2010.
U.S. Appl. No. 11/240,139—Final Office Action dated Jun. 9, 2010.
U.S. Appl. No. 11/536,115—Non-final Office Action dated Jun. 15, 2010.
U.S. Appl. No. 11/218,033—Final Office Action dated May 14, 2010.
E. Uemukai Toshiaki, A WWW Browsing System in Remote Display Environments, IPSJ magazine, Information Processing Society of Japan, Publication Date: Sep. 15, 2000, vol. 41, No. 9, p. 2364 to 2373.
Foreign Patent App. No. JP2006256440—Office Action filed for a related foreign application dated Jun. 7, 2010 corresponding to U.S. Appl. No. 11/233,270.
Foreign Patent App. No. JP2006261564—Office Action filed for a related foreign application dated Jun. 15, 2010 corresponding to U.S. Appl. No. 11/241,010.
Foreign Patent App. No. JP2006207195—Office Action filed for a related foreign application dated Jul. 27, 2010 corresponding to U.S. Appl. No. 11/192,617.
U.S. Appl. No. 10/962,248—Final Office Action dated Aug. 17, 2010.

U.S. Appl. No. 10/961,594—Non-Final Office Action dated Sep. 15, 2010.
U.S. Appl. No. 11/233,202—Non-Final Office Action dated Jul. 27, 2010.
U.S. Appl. No. 11/233,201—Non-Final Office Action dated Sep. 15, 2010.
U.S. Appl. No. 11/232,552—Final Office Action dated Aug. 19, 2010.
U.S. Appl. No. 11/241,501—Final Office Action dated Jul. 22, 2010.
U.S. Appl. No. 11/241,497—Notice of Allowance dated Aug. 11, 2010.
U.S. Appl. No. 11/241,498—Final Office Action dated Jul. 22, 2010.
U.S. Appl. No. 11/192,862—Non-Final Office Action dated Jul. 26, 2010.
U.S. Appl. No. 11/192,937—Notice of Allowance dated Sep. 7, 2010.
U.S. Appl. No. 11/192,865—Final Office Action dated Mar. 4, 2010.
U.S. Appl. No. 11/192,865—Non-Final Office Action dated Sep. 2, 2010.
U.S. Appl. No. 11/192,629—Final Office Action dated Aug. 25, 2010.
U.S. Appl. No. 11/192,796—Notice of Allowance dated Sep. 10, 2010.
U.S. Appl. No. 11/256,493—Final Office Action dated Aug. 20, 2010.
U.S. Appl. No. 11/240,084—Final Office Action dated Aug. 6, 2010.
Canon USA, Inc.; MEAP Multifunctional Embedded Application Platform; Aug. 2004; http://developersuport.canon.com/Web_MEAP¯Presentation.pdf.
Canon USA, Inc.; MEAP: FAQ; accessed on Jul. 2004, pub. date unknown; http://developersupport.canon.com/MEAP.htm.
Xerox, Inc.; Xerox FreeFlow digital workflow collection; 2003; http://www.xerox.com/downloads/usa/en/s/solutions_digital_workflow_whitepaper_sdk.pdf.
Ricoh Company, Ltd.; Ricoh's Medium-Term Management Plan; Mar. 19, 2002; http://www.ricoh.com/IR/data/pre/pdf/ir_pre2002.pdf.
Ricoh Company, Ltd.; White Paper: Embedded Software Architecture SDK; Jun. 25, 2003. http://www.ricoh-usa.com/products/concept/esa.asp?catname=ESA.
Hewlett-Packard Company; JetCAPS Scan2Folder; 2003; http://www.jetcaps.se/resources/datasheets/ds_scan2folder.pdf.
Hewlett-Packard Company; JetCAPS chai applications; Dec. 9, 2002; http://www.stethos.com/chai/data/d_us_chai.pdf.
Foreign Patent App. No. JP2006205150—Office Action filed for a related foreign application dated Sep. 28, 2010 corresponding to U.S. Appl. No. 11/192,500.
Foreign Patent App. No. JP2006207198—Office Action filed for a related foreign application dated Sep. 21, 2010 corresponding to U.S. Appl. No. 11/192,836.
Foreign Patent App. No. JP2006256441—Office Action filed for a related foreign application dated Nov. 9, 2010 corresponding to U.S. Appl. No. 11/233,202.
Foreign Patent App. No. JP2006256440—Office Action filed for a related foreign application dated Oct. 19, 2010 corresponding to U.S. Appl. No. 11/233,270.
U.S. Appl. No. 10/961,793—Non-Final Office Action dated Oct. 28, 2010.
U.S. Appl. No. 10/961,911—Final Office Action dated Oct. 20, 2010.
U.S. Appl. No. 11/233,270—Notice of Allowance dated Nov. 30, 2010.
U.S. Appl. No. 11/241,010—Final Office Action dated Oct. 15, 2010.
U.S. Appl. No. 11/240,156—Non-Final Office Action dated Nov. 10, 2010.
U.S. Appl. No. 11/256,479—Non-Final Office Action dated Nov. 23, 2010.
U.S. Appl. No. 11/193,152—Non-Final Office Action dated Mar. 1, 2010.
U.S. Appl. No. 11/193,152—Final Office Action dated Nov. 18, 2010.
U.S. Appl. No. 11/193,151—Non-Final Office Action dated Mar. 29, 2010.
U.S. Appl. No. 11/193,151—Final Office Action dated Nov. 2, 2010.
U.S. Appl. No. 11/192,824—Final Office Action dated Oct. 22, 2010.
U.S. Appl. No. 11/465,747—Final Office Action dated Mar. 9, 2010.
U.S. Appl. No. 11/241,447—Non-Final Office Action dated Dec. 8, 2010.
U.S. Appl. No. 11/193,076—Final Office Action dated Jan. 6, 2011.
U.S. Appl. No. 11/192,630—Final Office Action dated Dec. 8, 2010.
U.S. Appl. No. 11/192,868—Final Office Action dated Dec. 8, 2010.
U.S. Appl. No. 11/193,188—Final Office Action dated Dec. 8, 2010.
U.S. Appl. No. 11/192,615—Non-Final Office Action dated Jan. 4, 2011.
U.S. Appl. No. 11/192,467—Notice of Allowance dated Dec. 22, 2010.
U.S. Appl. No. 11/465,747—Notice of Allowance dated Dec. 28, 2010.
Foreign Patent App. No. JP2006205159—Japanese Office Action filed for a related foreign application dated Sep. 27, 2011 corresponding to U.S. Appl. No. 11/192,500.
U.S. Appl. No. 11/232,552—Final Office Action dated Aug. 5, 2011.
U.S. Appl. No. 11/465,722—Non-Final Office Action dated Aug. 5, 2011.
U.S. Appl. No. 11/192,862—Non-Final Office Action dated Oct. 13, 2011.
U.S. Appl. No. 11/192,870—Final Office Action dated Aug. 8, 2011.
U.S. Appl. No. 11/192,500—Non-Final Office Action dated Sep. 30, 2011.
U.S. Appl. No. 11/192,615—Final Office Action dated Oct. 11, 2011.
U.S. Appl. No. 11/465,752—Final Office Action dated Oct. 31, 2011.
U.S. Appl. No. 10/961,594—Notice of Allowance dated Oct. 13, 2011.
U.S. Appl. No. 11/465,699—Notice of Allowance dated Sep. 30, 2011.
U.S. Appl. No. 11/241,011—Notice of Allowance dated Sep. 6, 2011.
U.S. Appl. No. 11/192,617—Notice of Allowance dated Oct. 11, 2011.
U.S. Appl. No. 11/193,076—Notice of Allowance dated Oct. 11, 2011.
U.S. Appl. No. 11/192,546—Notice of Allowance dated Aug. 30, 2011.
U.S. Appl. No. 11/192,616—Notice of Allowance dated Oct. 11, 2011.
U.S. Appl. No. 11/193,151—Notice of Allowance dated Aug. 22, 2011.
U.S. Appl. No. 11/241,320—Notice of Allowance dated Oct. 11, 2011.
U.S. Appl. No. 11/240,139—Notice of Allowance dated Oct. 11, 2011.
U.S. Appl. No. 11/240,084—Notice of Allowance dated Oct. 11, 2011.
U.S. Appl. No. 11/218,033—Notice of Allowance dated Oct. 11, 2011.
U.S. Appl. No. 11/218,186—Notice of Allowance dated Oct. 11, 2011.
Foreign Patent App. No. JP2006261563—Interrogation Report filed for a related foreign application dated Jun. 7, 2011 corresponding to U.S. Appl. No. 11/241,501.
Foreign Patent App. No. JP2006207200—Interrogation Report filed for a related foreign application dated Mar. 8, 2011 corresponding to U.S. Appl. No. 11/192,615.
U.S. Appl. No. 10/961,594—Final Office Action dated May 19, 2011.
U.S. Appl. No. 11/232,827—Non-Final Office Action dated May 26, 2011.
U.S. Appl. No. 11/233,202—Final Office Action dated Mar. 23, 2011.
U.S. Appl. No. 11/465,699—Non-Final Office Action dated Mar. 23, 2011.
U.S. Appl. No. 11/241,011—Non-Final Office Action dated Feb. 17, 2011.
U.S. Appl. No. 11/192,617—Non-Final Office Action dated Jun. 9, 2011.
U.S. Appl. No. 11/192,546—Non-Final Office Action dated Feb. 17, 2011.
U.S. Appl. No. 11/192,862—Final Office Action dated Mar. 21, 2011.

U.S. Appl. No. 11/192,870—Non-Final Office Action dated Feb. 22, 2011.
U.S. Appl. No. 11/192,616—Non-Final Office Action dated Jun. 9, 2011.
U.S. Appl. No. 11/192,500—Final Office Action dated Mar. 21, 2011.
U.S. Appl. No. 11/193,151—Non-Final Office Action dated Mar. 16, 2011.
U.S. Appl. No. 11/192,824—Non-Final Office Action dated Jun. 9, 2011.
U.S. Appl. No. 11/192,547—Final Office Action dated Mar. 7, 2011.
U.S. Appl. No. 11/465,752—Non-Final Office Action dated Apr. 1, 2011.
U.S. Appl. No. 11/241,320—Non-Final Office Action dated Jun. 9, 2011.
U.S. Appl. No. 11/240,139—Non-Final Office Action dated Jun. 10, 2011.
U.S. Appl. No. 11/240,084—Non-Final Office Action dated May 12, 2011.
U.S. Appl. No. 11/536,115—Final Office Action dated Mar. 10, 2011.
U.S. Appl. No. 11/218,033—Non-Final Office Action dated Jun. 9, 2011.
U.S. Appl. No. 11/218,186—Non-Final Office Action dated Jun. 16, 2011.
U.S. Appl. No. 10/962,248—Notice of Allowance dated Apr. 1, 2011.
U.S. Appl. No. 10/961,793—Notice of Allowance dated Jun. 10, 2011.
U.S. Appl. No. 10/962,103—Notice of Allowance dated Feb. 22, 2011.
U.S. Appl. No. 11/233,201—Notice of Allowance dated Jun. 24, 2011.
U.S. Appl. No. 11/241,501—Notice of Allowance dated Feb. 17, 2011.
U.S. Appl. No. 11/241,010—Notice of Allowance dated May 27, 2011.
U.S. Appl. No. 11/241,071—Notice of Allowance dated May 3, 2011.
U.S. Appl. No. 11/241,447—Notice of Allowance dated Jul. 13, 2011.
U.S. Appl. No. 11/241,498—Notice of Allowance dated Apr. 1, 2011.
U.S. Appl. No. 11/240,156—Notice of Allowance dated Jul. 12, 2011.
U.S. Appl. No. 11/256,479—Notice of Allowance dated Jul. 13, 2011.
U.S. Appl. No. 11/192,630—Notice of Allowance dated May 31, 2011.
U.S. Appl. No. 11/192,865—Notice of Allowance dated May 19, 2011.
U.S. Appl. No. 11/192,868—Notice of Allowance dated Apr. 29, 2011.
U.S. Appl. No. 11/193,152—Notice of Allowance dated Apr. 8, 2011.
U.S. Appl. No. 11/192,629—Notice of Allowance dated Apr. 11, 2011.
U.S. Appl. No. 11/192,824—Notice of Allowance dated Apr. 20, 2011.
U.S. Appl. No. 11/256,493—Notice of Allowance dated Apr. 15, 2011.
U.S. Appl. No. 11/232,827—Notice of Allowance dated Dec. 1, 2011.
U.S. Appl. No. 11/232,552—Notice of Allowance dated Jan. 20, 2012.
U.S. Appl. No. 11/465,722—Final Office Action dated Feb. 5, 2011.
U.S. Appl. No. 11/465,752—Notice of Allowance dated Feb. 14, 2012.
U.S. Appl. No. 11/536,115—Non-final Office Action dated Feb. 24, 2012.

* cited by examiner

METHODS AND SYSTEMS FOR PERIPHERAL ACCOUNTING

BACKGROUND OF THE INVENTION

Imaging devices such as printers, copiers, scanners and fax machines can have a wide array of functions and capabilities to fit specific uses or combinations of uses. Imaging devices often take the form of a multi-function peripheral device (MFP) that combines the functions of two or more of the traditionally separated imaging devices. An MFP may combine any number of imaging devices, but typically comprises the functions of a printer, scanner, copier and fax machine.

Some imaging devices may contain computing resources for data storage and processing such as processors, hard disk drives, memory and other devices. As imaging devices add more features and functions, they become more costly and complex.

More complex imaging devices and MFPs may comprise network connectivity to provide communication with other computing devices, such as personal computers, other imaging devices, network servers and other apparatus. This connectivity allows the imaging device to utilize off-board resources that are available on a connected network.

Imaging devices typically have a user input panel with an array of buttons, knobs and other user input devices. Some devices also have a display panel, which can be for display only or can be a touch panel display that enables user input directly on the display.

Devices with touch panel displays or displays with buttons arranged in cooperation with the display can display menu data that may be selected by user input. This menu data is typically driven by an on-board server module within the imaging device.

BRIEF SUMMARY OF THE INVENTION

Embodiments of the present invention comprise systems, methods and devices for interacting with a remote computing device from an imaging device. These embodiments comprise remote computing devices configured to communicate with imaging devices, imaging devices configured to communicate with remote computing devices and systems comprising various combinations of remote computing devices in communication with imaging devices.

The foregoing and other objectives, features, and advantages of the invention will be more readily understood upon consideration of the following detailed description of the invention taken in conjunction with the accompanying drawings.

DETAILED DESCRIPTION OF PREFERRED EMBODIMENTS

Figure 1:
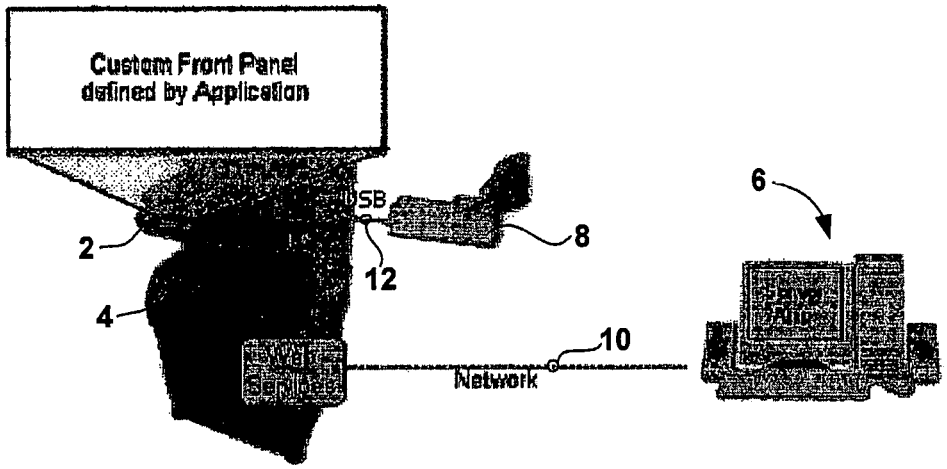
FIG. 1 is a diagram of an embodiment of the present invention comprising an imaging device in connection with a remote computing device.

Embodiments of the present invention will be best understood by reference to the drawings, wherein like parts are designated by like numerals throughout. The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the methods and systems of the present invention is not intended to limit the scope of the invention but it is merely representative of the presently preferred embodiments of the invention.

Elements of embodiments of the present invention may be embodied in hardware, firmware and/or software. While exemplary embodiments revealed herein may only describe one of these forms, it is to be understood that one skilled in the art would be able to effectuate these elements in any of these forms while resting within the scope of the present invention.

Embodiments of the present invention comprise interfaces and architecture that integrate imaging devices with remote computing device applications and environments to provide solutions that may not be possible solely with an imaging device alone. Some embodiments comprise an infrastructure and set of interfaces that allow applications on a network to programmatically control imaging device functions and interact with a user through an imaging device input panel. Software functions that are not practical within the imaging device can be performed on the server but are accessible from the imaging device.

For the purposes of this specification and claims, an imaging device (IDev) may be described as a device that performs an imaging function. Imaging functions comprise scanning, printing, copying, image transmission (sending and receiving), image conversion and other functions. Exemplary imaging devices comprise printers, copiers, facsimile machines, scanners, computing devices that transmit, convert or process images and other devices. An IDev may also perform multiple imaging functions. For example, and not by way of limitation, a multi-function peripheral device (MFP), which typically has the capability to perform a plurality of functions comprising a printer, scanner, copier and/or a facsimile machine or image transmitter/receiver, is a type of imaging device. Other MFP imaging devices may comprise other combinations of functions and still qualify as an IDev.

For the purposes of this specification and claims, a remote computing device (RCD) is a device capable of processing data and communicating with other devices through a communications link. An RCD is a remote device because it requires a communications link, such as a network connection, a telephone line, a serial cable or some other wired or wireless link to communicate with other devices such as an imaging device. Some exemplary RCDs are network servers, networked computers and other processing and storage devices that have communications links.

Figure 2:
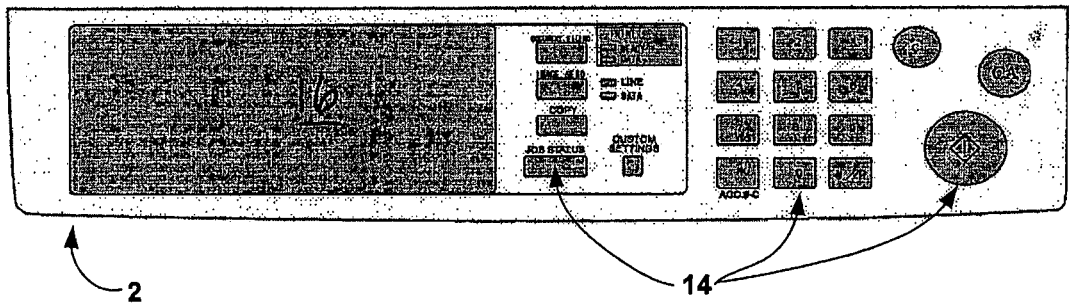
FIG. 2 is an image of an exemplary user interface for an imaging device.

Some embodiments of the present invention may be described with reference to FIGS. 1 & 2. These embodiments comprise an imaging device (IDev) 4 that may be a multi-function peripheral device (MFP) or a single function device. The imaging device 4 further comprises a user interface (UI) panel 2, which may comprise input buttons 14 and a display device 12 or may comprise a touch panel system with or without buttons 14. User input and display may also be performed through a separate UI device 8, which may be connected to the imaging device 4 by a communication link 12, such as a USB connection, a network cable, a wireless connection or some other communications link. UI device 8 may comprise an input device, such as a keyboard or buttons as well as a display device, which may also be a touch screen panel. UI device 8 may also comprise an interface for transfer of instructions that are input to the device 8 from a remote input device. This form of UI device 8 may comprise memory sticks, USB memory cards and other storage devices that may be configured to store input for transfer to an imaging device.

These embodiments further comprise a remote computing device (RCD) 6 that is linked to the imaging device 4 via a communications link 10, such as a network connection. This network connection may be a typical wired connection or a wireless link.

Embodiments of the present invention may provide menu data from the RCD 6 to the imaging device UI panel 2 or remote panel 8 via the network connection 10. Once this menu data is fed to the imaging device 4, an UI panel 2, 8 on the imaging device 4 may be used to interact with applications that run on the remote computing device 6. User input received from UI panels 2, 8 may be returned directly to the remote computing device 6.

A Web Service is a software application identified by a Uniform Resource Identifier (URI), whose interfaces and binding are capable of being defined, described and discovered by Extensible Markup Language (XML) artifacts and supports direct interactions with other software applications using XML based messages via Internet-based protocols.

An application on the remote computing device 6 may use one or more Web Services to control various features in the imaging device 4, such as enabling, disabling or setting device values or controlling device functions.

Embodiments of the present invention allow network applications running on remote computing devices to interact with the user of the imaging device through the imaging device I/O panel. These embodiments allow imaging device user interface (UI) control (i.e., touch panel, button/display) by applications. Some embodiments may also integrate custom display screens or menus with the native imaging device UI. Embodiments may hand off control of imaging device functions between standard operation modes performed on the imaging device in response to user input to an imaging device UI and open systems modes that utilize network resources, such as applications on RCDs, through user input at the imaging device UI.

Embodiments of the present invention comprise network-based applications that have full control over the imaging device UI to display text and graphics in any format. In these embodiments, the application can programmatically display buttons, textboxes, graphics, etc. in any layout desired.

In some embodiments, the UI layout is easy to program using a standard language, such as a markup language. These languages comprise Hypertext Markup Language (HTML), Extensible Markup Language (XML), Wireless Markup Language (WML), Extensible Hypertext Markup Language (XHTML) and other languages.

In some embodiments of the present invention a remote computing device application or server application is able to request a keyboard UI to be displayed on the imaging device display 12, 8. In some embodiments, this functionality is available on the imaging device and does not need to be recreated by remote computing device applications. In some embodiments, the remote computing device may define the keyboard prompt and default values. These embodiments may comprise a remote computing device that is able to rename imaging device UI buttons, such as the OK and Cancel buttons as well as define additional buttons.

In some embodiments, menu templates may be served to the imaging device UI by the imaging device itself 4 or from a remote computing device 6.

External Authorization Application

Some embodiments of the present invention may comprise a remote computing device application that is registered as the External Authorization server. The External Authorization application may control access to the imaging device and may have top-level control of the UI. UI control may be given to this application in the same manner that control is given to an internal auditor.

In these embodiments, when an imaging device system boots, it checks to see if an External Authorization application is registered. If so, the imaging device is placed in disabled mode and the application is contacted to take control of the UI. If the External Authorization server is not available, an error message may be displayed and the device may remain disabled. The imaging device may periodically try to contact the External Authorization server until it is available. Table 1 below describes what entity has control of the UI, in an exemplary embodiment, when the device is in a disabled state.

TABLE 1

| UI Control in Disabled State | | |
|---|---|---|
| Button Press | UI Control | Indicator Lights |
| Device boots | External Application | None |
| Document Filing | External Application | None |
| Image Send | External Application | None |

TABLE 1-continued

| UI Control in Disabled State | | |
|---|---|---|
| Button Press | UI Control | Indicator Lights |
| Copy | External Application | None |
| Job Status | Device - standard Job Status screens | Job Status |
| Custom Settings | Device - standard Custom Settings screens | N/A |
| OS Mode | Not available when device is disabled | |

Remote Computing Device Applications

In embodiments of the present invention, access to the custom UI panels of imaging devices may vary from application to application. Some solutions, such as Document Management integration, may wish to leverage the native Image Send screens, but display some custom UI's to gather additional information about a scan job. Other solutions, like custom printing applications, may be accessed from a separate mode than the native functions.

In order to accommodate the diversified needs of these solutions applications, embodiments may support multiple integration points for UI control. These integration points are based on a user action ("trigger") for which applications may register. In some embodiments, applications may be registered with target devices so that the device knows that when "trigger A" occurs on the front panel to contact "remote computing device B" for instructions. In exemplary embodiments, applications may be integrated with an imaging device at any of several "trigger" points.

Remote computing devices may be registered to a specific function and contacted when that function's hardware key is pressed (e.g. Image Send) on the imaging device UI. Any UI information provided by the remote computing device may be displayed instead of the standard function screens native to the imaging device. This trigger may be used for applications that wish to replace the existing functions with completely custom UI's, such as an alternative scan solution or a specialized display, such as a "Section 508" compatible screen or other specialized-need interface that may have large buttons or other accommodations.

In some embodiments, each function on the imaging device may have a menu on the touch screen that remote computing devices, such as servers, can register. This enables solutions applications to provide custom content and still use some of the standard functionality provided by the imaging device. When a button assigned to a custom application is selected, a menu will be displayed with the solutions registered to that function. Users may select the desired solution and the remote computing device will be contacted for instructions.

In some embodiments, a stand-alone RCD mode that provides remote computing device application access can be accessed from the job queue portion of the UI that is displayed on every screen. This trigger point may be used for applications that do not fit within one of the standard device functions, such as custom printing solutions on an imaging device. When the RCD menu is selected, a menu will be displayed with the solutions applications registered to the generic RCD mode. Users will select the desired solution and the remote computing device will be contacted for instructions.

Hardware Key Interaction

In some embodiments of the present invention, when an imaging device is enabled, additional hardware keys may be used to manage the device. Hardware key assignments for an exemplary embodiment are shown in table 2.

TABLE 2

| Exemplary Hardware Key Assignments | | |
|---|---|---|
| Button Press | Standard IDev Mode | RCD Mode |
| Mode keys (Copy, Doc Filing, Image Send) and Custom Settings key | Clear current job settings, move to target screen | Clear current job settings, move to target screen |
| Job Status key | Move to Job Status, maintain current settings & UI location | Move to Job Status, maintain current settings & UI location |
| Clear (C) | Clears settings | Sends clear event to external application |
| Clear All (CA) | Clears settings, cancels job, and returns to default IDev screen | Cancels job and returns to default IDev screen (notification sent to external application) **When External Authorization is controlling the UI, only notification is sent |
| Start | Initiates scan function | Initiates scan function |
| Number keys | Input for copy count or fax numbers | Not used |
| * | Logs user out (disable device and contact External Authorization for screens) | Logs user out (disable device and contact External Authorization for screens) |

In some embodiments, in addition to the * key for logout, a timeout period may be implemented. Some embodiments also comprise an auto clear setting that can be configured for a given period of time, such as 10 to 240 seconds (or disabled). In these embodiments, when there is no activity for the time configured in auto clear, the device may automatically return to disabled mode and attempt to contact a remote computing device to retake control of the UI.

Error & Jam Notification

Depending on a particular solution, a remote computing device application may have full or only partial control of the imaging device UI and a particular imaging job. In some embodiments, partial control may include cases where a remote computing device is monitoring clicks, but native modes are responsible for the UI interaction and controlling the job. Partial control may also include cases where the remote computing device application is integrated with a native mode (UI trigger=function custom menu). In these embodiments, the imaging device may handle all error and jam notifications with only a notification sent to the relevant remote computing device application.

For some embodiments, in cases where the remote computing device application has full control over the UI and the job, error and jam notifications may be handled differently depending on the type of error. For recoverable errors, a notification may be sent to the remote computing device application and the application may be responsible for displaying messages and resolving the error. For non-recoverable errors, the imaging device and RCD mode may interact to gracefully handle the error condition (e.g. provide user with instructions for clearing jam).

Control Handoffs

In some embodiments, at different points throughout an imaging job, several applications may need control over an imaging device including, but not limited to, an External Authorization application, a standard RCD application, an imaging device native mode and other applications. The following section describes, for an exemplary embodiment, the various steps in an exemplary job, the entities that may have control during each step, and what type of control may be allowed.

STEP 1: User provides credentials to access the device at the device UI. This step may be controlled by a remote computing device, such as an External Authorization application or by Internal Accounting (native mode) in the imaging device itself. At the end of this step, the device is enabled. The External Authorization application may also specify default parameters or disable specific job parameters (e.g. default file format is PDF, but user may change; color mode is set to B/W and user may not change).

STEP 2: User sets parameters for the job using one of the native imaging device modes or a standard RCD application. At the end of this step the user makes an input to initiate the job. When the input is made, an optional notification may be sent to the standard RCD application, which can then change job parameters if desired. An e-mail application is one example of an application that may request notification when the user input is made. A user may use native Image Send screens or other input to select scan options and choose e-mail recipients. A user may then select a custom application button and choose the scan-to-e-mail option from the menu. The e-mail application may then display custom screens for the user to set permissions for the file. Once a user places the original document(s) on the scanner and initiates the process, the e-mail application may capture the destination parameters set by the user and change the target destination to the e-mail application FTP server. The e-mail application may then receive the file, apply the appropriate permissions, and send to the e-mail recipients selected by the user. A remote computing device application may also want to retake control of the UI at this point, if, as in some embodiments, the application generates thumbnails of the scanned images and displays them to the user for verification.

STEP 3: Once the job is initiated, the imaging device is responsible for scanning or RIPing the job and spooling it to the HDD. If the imaging device is configured to authorize jobs with an external authorization application, it may send a click report to the application and wait for instructions. The external authorization application may enable the job for sending/printing, cancel the job, or change job parameters (and then enable). As an example, a rules-based printing application may wish to change job parameters after it receives a click report. Some rules-based printing applications support rules-based printing and scanning that can limit what each user is allowed to do based on the time of day, the destination, or many other parameters. For example, only users in the marketing group may be able to scan high-quality color images. If a user from another group selects color and 600 dpi, a rules-based application may change the parameters to color and 200 dpi. At the end of this step the job should either be authorized or canceled.

STEP 4: In some embodiments, this may be an optional step, where the standard RCD application in step 2 may have specified the destination as a HDD for temporary storage. This step may also be used, in some embodiments, by a Java application running on the imaging device. For example, a government office may have a custom encryption application running on the device that takes the scanned document, encrypts it, and then requests the imaging device to send it to the target destination selected by the user in step 2. In some embodiments, it may be beneficial to send a notification to the external authorization application after this step—because the imaging device does not know how long the file will be on the HDD or what the application is going to do with it—and after the send/print step.

STEP 5: In the final step, the file is actually output. In typical embodiments, the file is either sent over the network or printed locally. At the end of this step, a notification that the job was successfully completed should be sent to the external authorization application and optionally, to the standard RCD application.

Device Control and Management API's

The API's may be used to allow a remote computing device application to control access to an imaging device for vend applications and to manage the device from a remote location.

Device Control and Vend API

In some embodiments of the present invention, a Device Control and Vend API allows applications to enable and disable access to the device and track click counts. The Device Control and Vend API may provide an RCD with the following controls:

ENABLE/DISABLE DEVICE OF FUNCTION—this may allow an RCD to enable or disable access to the device as a whole or by function to enforce individual user privileges. In some exemplary embodiments, the functions listed in Table 3 may be selectively enabled or disabled by an application.

TABLE 3

| Device Functions | |
|---|---|
| Enable/Disable | Description |
| Copy | Copy function (Copy button) |
| Image Send | Scan and fax function, plus send from Doc Filing (Image Send button) |
| Document Filing | All access to Document Filing functions (Document Filing button) |
| Print | Network prints, pull print from front panel, and print from Document Filing (No button control) |

REPORT CLICKS USED—at the end of a successful job, the clicks used may be reported back to an RCD including:

TABLE 4

| Job and Page Characteristics | | | | | | | |
|---|---|---|---|---|---|---|---|
| Item | Copy | Print | Fax Send | PC-Fax | E-mail/FTP | Broad-cast | Scan to HD |
| JOB Characteristics | | | | | | | |
| Job Mode | Yes | Yes | Yes | Yes | Yes | Yes | Yes |
| Broadcast | No | No | Yes | Yes | Yes | Yes | No |
| Manage No. | | | | | | | |
| User Name | Yes | Yes | Yes | Yes | Yes | Yes | Yes |
| Address | No | No | Yes | Yes | Yes | # | No |
| Start Time | Yes | Yes | Yes | Yes | Yes | Yes | Yes |
| End Time | Yes | Yes | Yes | Yes | Yes | Yes | Yes |
| Total Page | Yes | Yes | Yes | Yes | Yes | Yes | Yes |
| Result | Yes | Yes | Yes | Yes | Yes | Yes | Yes |
| Error Cause | No | No | Yes | Yes | Yes | Yes | No |
| Doc Filing | Yes | Yes | Yes | Yes | Yes | Yes | Yes |
| Save Mode | *1 | *1 | *1 | *1 | *1 | *1 | *1 |
| File Name | *1 | Yes | *1 | Yes | Yes | *1 | Yes |
| File Size | Yes | Yes | *1 | *1 | *1 | *1 | Yes |
| Resolution | Yes | Yes | Yes | Yes | Yes | Yes | Yes |
| Special | Yes | Yes | Yes | No | Yes | Yes | Yes |
| Finishing | Yes | Yes | No | No | No | No | No |
| File Format | No | No | No | No | Yes | Yes | No |
| Compression | No | No | No | No | Yes | Yes | No |
| PAGE Characteristics | | | | | | | |
| Copy | Yes | Yes | Yes | Yes | Yes | # | Yes |
| Paper Size | Yes | Yes | Yes | Yes | Yes | Yes | Yes |
| Simplex/duplex | Yes | Yes | Yes | Yes | Yes | Yes | Yes |
| Paper Type | Yes | Yes | Yes | Yes | No | No | Yes |
| Page | Yes | Yes | Yes | Yes | Yes | Yes | Yes |

*1 - Yes when Document Filing is used

Debit Mode—in these embodiments, when an application enables the device it may specify if the current job requires authorization. If so, the job will be spooled to memory and click information (e.g., as defined in Table 4) will be sent to an RCD. An RCD will then notify the device if the job should be deleted or output/sent. At this point, the application also has the option of changing job parameters. If the application does not require authorization, the job will continue as normal and a click report will be sent at the end of the job.

Print Job Accounting—in these embodiments, an RCD may wish to monitor print jobs along with walk-up functions. For print job accounting, an IDev may monitor all incoming print jobs and send accounting data in the PJL header to an RCD for verification before printing the job. The RCD will evaluate the accounting data (or lack thereof) and inform the IDev to continue with or cancel the job.

Report on Unidentified Jobs—in these embodiments, an RCD may also wish to monitor print jobs that it cannot associate to a specific user, such as device reports and incoming fax jobs. The RCD can register to receive click counts for all unidentified jobs, so that it may bill them to a general account.

Device Management API

In some embodiments of the present invention, a Device Management API allows a network application to remotely setup and manage the imaging device. In exemplary embodiments, the Device Management API may provide an RCD with the following controls:

- Device Status—an RCD may request the current status of the device. This is the same status information as reported on the embedded web pages.
- Device Configuration—an RCD can retrieve a list of installed options supported by the device.
- Web Page Settings—an RCD application can retrieve and set any of the values that are configurable on the embedded web pages.
- Key Operator Programs—an RCD application can retrieve and set any of the values that are configurable in Key Operator Programs, including software keys.
- Custom Settings—an RCD application can retrieve and set any of the values that are configurable in Custom Settings.
- Job Status—an RCD application can retrieve the current job queue and history information and reprioritize or delete jobs in the queue.
- Click Counts—an RCD application can retrieve device total counts and clicks for each function by account code.
- Data Security Settings—an RCD application may retrieve the status information on the DSK (e.g. last erase) and initiate data clear functions.
- RED Data—an RCD can retrieve all data typically sent in a RED message.
- Remote Reboot—an RCD can initiate a reboot of the imaging device.

The above groupings are provided only as an exemplary embodiment detailing which settings should be included. In some embodiments, actual API's should be grouped by functional areas since there may be overlap between Key Operator settings and web page settings.

Internal Accounting API

In some embodiments, an Internal Accounting API may allow a remote computing device application to configure internal accounting and report click counts. In some exemplary embodiments an Internal Accounting API may include:

- Set Auditing Options—an RCD may set auditing options including which modes auditing is enabled for, "account number security", and "cancel jobs of invalid accounts."
- Manage Account Codes—an RCD can add, edit, or delete account codes
- Account Limits—an RCD application can specify a maximum number of clicks by function for individual account codes or for all account codes
- Account Reset—an RCD application can reset the click count for an individual account or for all accounts
- Retrieve Clicks—an RCD can retrieve the number of clicks by function for each account code Font and Form Management API Some embodiments of the present invention may comprise a Font and Form Management API, which allows an RCD application to remotely download and manage fonts and forms in mass-storage. In some exemplary embodiments, a Font and Form Management API may provide a remote computing device with the following controls:

- Mass Storage Control—an RCD application can retrieve mass storage status information including storage capacity, space available, and write-protect mode plus modify write-protect status.
- Resource List—an RCD application can retrieve a list of stored fonts and forms including font or macro ID, font number, font/form name, escape sequence, and file size.
- Download Resource—an RCD application can download PCL fonts, PCL macros, and PS fonts and forms. Any special processing that is performed when a resource is downloaded via the web pages will also be performed when the resource is downloaded via Open Systems.
- Delete Resource—an RCD application can delete any resource stored in mass storage.
- Upload Resources—an RCD application can upload an individual or all resources. On devices where effective memory management is unavailable, a server application can use this function to "defrag" mass storage.
- Font/Macro ID's—an RCD application can assign or modify the ID's assigned to PCL fonts and macros.

Firmware Management API

In some embodiments of the present invention, a Firmware Management API may allow a remote computing device or network application to remotely download and manage the imaging device firmware. In some exemplary embodiments, a Firmware Management API may provide a remote computing device (e.g., a server) with the following controls:

- Firmware Versions—an RCD application can retrieve the current firmware version numbers.
- Service Mode—an RCD application can place the MFP in service mode to lockout other jobs that will interfere with firmware upgrade. Upon receiving a service mode request, the IDev will stop accepting incoming jobs, complete all jobs in the queue, and then notify the server that it is in service mode.
- Update Firmware—an RCD can download an updated firmware version to the device. If a reboot is necessary, the IDev will perform it automatically when download is complete.
- Download Status—the IDev will send a status notification (success/error) to an RCD after firmware download.
- Revert to Previous Version—if firmware update is not successful, the application can request the IDev to revert to the previous firmware version.

Device Function API's

In some embodiments of the present invention, device function API's allow a remote computing device application to use existing imaging device functionality to provide new custom solutions.

Image Send API

In some embodiments, an Image Send API may provide the remote computing device application with the following controls:

- Image Send Parameters—a remote computing device application can get and set values for the following scan and fax parameters:
  - Color or B/W
  - Image Mode—text, text/photo, photo; exposure level
  - Resolution
  - File format—file type, compression, and pages per file
  - Original—original size, simplex/duplex, rotate, and job build
  - Filename
  - Subject
  - Message
  - Sender
  - Schedule send time
  - Page division (book scanning)
  - Cover page
  - Transmission message (confidential, urgent, etc.)
  - Thin paper scanning
  - Destination
  - Document Filing
- Initiate Scan—the remote computing device application can initiate the scan function (same as user pressing start button).

In some embodiments, a remote computing device can change the default values on the imaging device or the values for the current job. For the current job, the remote computing device may also specify if scan parameters may be modified by the user or not. If one remote computing device application (e.g. Access Control) specifies that a parameter cannot be changed and then a second application (e.g. Document Management) tries to set the parameter, a notification may be sent to the second application and the setting will not be changed.

Print API

In some embodiments, print jobs may be submitted by remote computing device applications using standard printing channels. In some exemplary embodiments, a Print API may provide a remote computing device with the following additional control:

- PJL Sniffing—an RCD application can register with the IDev to be contacted for instructions when a specific PJL command is found in a print job. The RCD can then instruct the IDev to replace the command, cancel the job, or continue printing. This interface may be used in applications like accounting and other-brand compatibility.

Copy API

In some embodiments of the present invention, a Copy API may provide a remote computing device with the following exemplary controls:

- Copy Parameters—an RCD application can get and set values for the following copy parameters:
  - Color or B/W
  - Exposure—text, text/photo, photo, super photo; exposure level
  - Paper select (by tray)
  - Copy ratio
  - 2-sided copy—1to1, 1to2, 2to2, 2to1; binding edge
  - Output—output tray, sort, staple, group, offset
  - Original size
  - Special functions—margin shift, erase, pamphlet, etc.
  - Document Filing
- Initiate Copy—an RCD application can initiate the copy function (same as user pressing start button).

In some embodiments, a remote computing device can change the default values on the imaging device or the values for the current job. For the current job, the remote computing device may also specify if copy parameters may be modified by the user or not.

Document Filing API

In some embodiments of the present invention, a Document Filing API may provide a remote computing device with the following exemplary controls:

- Backup/Restore—the remote computing device application can import and export a batch file with all Document Filing data. In some embodiments, this package will be in a proprietary format since it contains documents that are password-protected and should not be accessed individually—this is typically for restore in case of failure or cloning to other devices.
- File/Folder List—the remote computing device application can retrieve, modify, and create new files and folders to be stored on the IDev (also covered in device management).
- Download File—the remote computing device can download a new file to the Document Filing systems and specify folder, filename, usemame, and password.
- User List—the remote computing device application can retrieve, modify, and create new users to be stored on the IDev (also covered in device management).
- HDD Status—the remote computing device application can retrieve the current HDD status including the % allocated to the main folder, quick folder, and custom folders and the % remaining.
- Doc Filing Parameters—the remote computing device application can get and set values for storing a file to Doc Filing including:
  - Exposure
  - Resolution
  - Original—size, simplex/duplex
  - File Information—username, filename, folder, confidential, password
  - Special Modes—Erase, Dual Page Copy, 2in1, Job Build, Card Shot
- Initiate Print—the remote computing device application can select a stored file and initiate a print including the following parameters:
  - Paper size/source
  - Output—sort/group, output tray, staple, punch, offset
  - Simplex/duplex (tablet/booklet)
  - Tandem print
  - Number of copies
  - Delete or store after printing
- Initiate Send—the remote computing device application can select a stored file and initiate a send including the following parameters:
  - Resolution
  - File format
  - Destination
  - Timer
  - Sender
  - Filename
  - Subject
  - Message

Security

Allowing external applications to control an imaging device opens up the imaging device to new security vulnerabilities. In embodiments of the present invention that provide some security measures, the following exemplary items are security concerns that may be addressed by the remote computing device interface.

Access to remote computing device interfaces may be limited to valid applications. Embodiments provide extensive access and control of the imaging device, which poses a significant security risk. The interface of these embodiments may be protected from access by attackers, while maintaining ease of setup and use for valid solutions.

Confidential data (user credentials and job data) may be protected during network transfer. User credentials and job data may be secured during network transfer to ensure that it cannot be stolen, an intruder cannot monitor device activity, and a man-in-the-middle attack cannot change messages. Imaging devices may support Secure Sockets Layer (SSL) and other connections to ensure data is safe while being communicated between the imaging device and remote computing device applications.

Administrators may have the ability to lock-down imaging device access. For users with strict security policies, administrators may have the ability to disable access by remote computing devices or limit access to specific applications. Administrators may have an option to register the limited applications that they wish to access the imaging device interfaces.

Remote computing device applications may ensure the imaging device is not being "spoofed." The remote computing device may be able to authenticate an imaging device that it is contract with it to ensure an intruder cannot imitate the imaging device to collect network configuration and password information, monitor file/folder structures of a document management system, or spoof security settings and DSK status of the imaging device.

A remote computing device may ensure that the server is not being "spoofed." The imaging device must be able to authenticate all remote computing devices that it is in contact with to ensure that an intruder is not spoofing the remote computing device's IP address. By pretending to be the remote computing device, an intruder could steal user credentials, redirect scanned documents, change device settings or firmware, or bring down the access control system (either to provide access to unauthorized users or initiate a denial of service attack for valid users).

Access control/vend applications may not be compromised when a remote computing device is unavailable. When the remote computing device is unavailable, it may not be acceptable to provide open access to the device. If the remote computing device is unavailable at startup or becomes unavailable at anytime (e.g. someone disconnects network cable), the imaging device may immediately be disabled and an error message displayed.

An administrator may be able to adjust a security level based on company and application requirements. Security requirements can have a large impact on the time it takes to develop a remote computing device application and the resources required to implement the solution. Users using some embodiments may range from a small business with one imaging device, no IT staff, and a simple scan or print application to a large government office using access control and audit trails to track all device activity. The security measures used to protect imaging device interfaces may be adjustable by the administrator to match the target environment.

The imaging device and remote computing device applications may be able to hand-off user credentials. Users may be prompted to login at multiple points throughout a job. For example, an access control application or accounting application may control total device access, the imaging device may have user authentication enabled for Image Send, and a document management application may require user login before showing a folder list. In many environments, all of these applications will use a common user database. In some embodiments, it is, therefore, desirable for the applications to pass user credentials to each other, so that each one does not have to repeat the authentication process.

Some embodiments of the present invention may be described with reference to FIG. 3. These embodiments comprise an imaging device only, which is configured to interact with a remote computing device, such as a server through a communications link. The imaging device 30 comprises a user interface 32, which comprises a user input device 34, such as a keypad, one or more buttons, knobs or switches or a touch-screen panel and a display 36, which may comprise user input device 34 in the form of a touch-screen panel.

Imaging device 30 will typically be capable of performing one or more imaging functions including, but not limited to, scanning, printing, copying, facsimile transmission (sending and receiving) and others.

Figure 3:
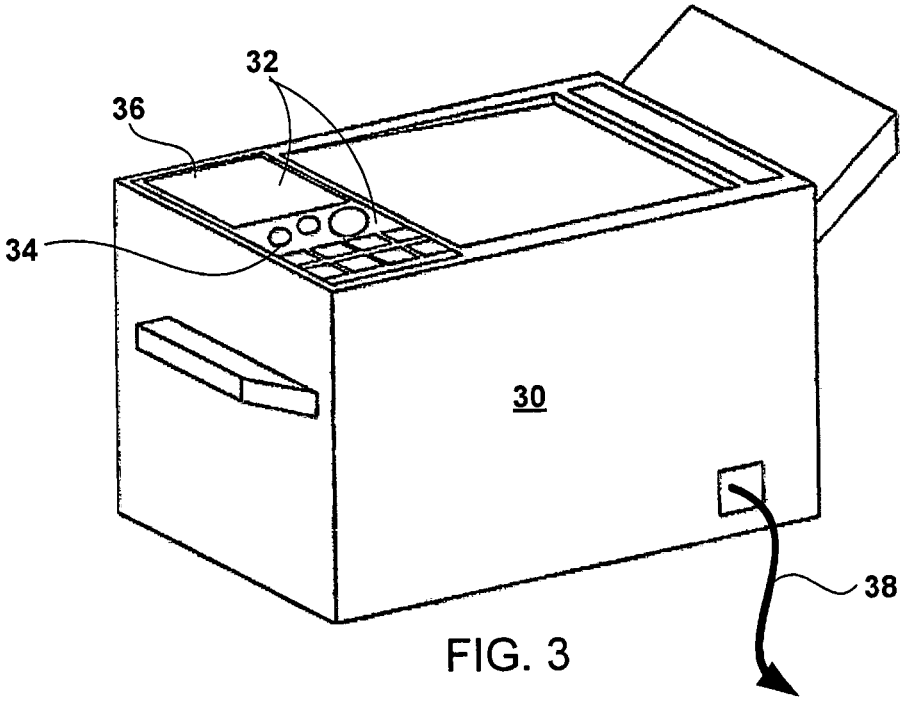
FIG. 3 shows an exemplary imaging device.

These embodiments further comprise a communications link 38, which may be a wired connection (as shown in FIG. 3) comprising a network cable, a Universal Serial Bus (USB) cable, a serial cable, a parallel cable, a powerline communication connection such as a HomePlug connection or other wired connections. Alternatively, the communications link 38 may comprise a wireless connection, such as an IEEE 802.11 (b) compliant connection, a Bluetooth connection, an Infrared Data Association (IrDA) connection or some other wireless connection.

Figure 4:
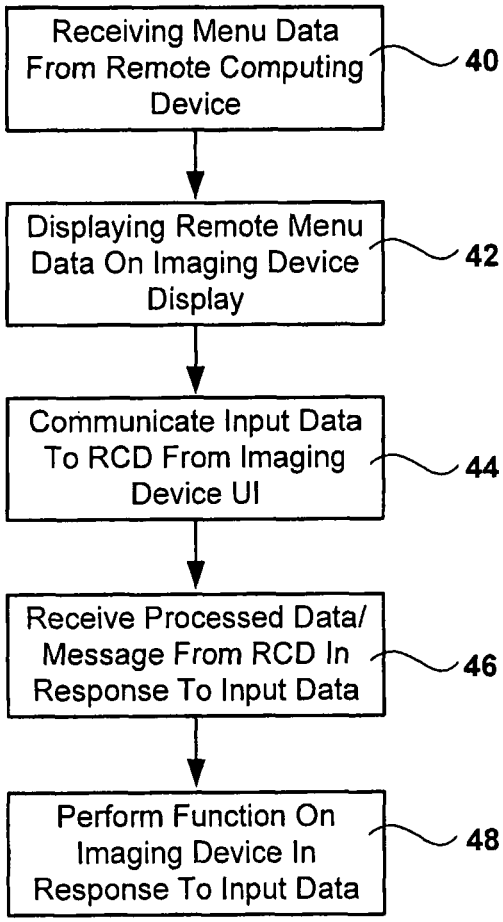
FIG. 4 is a chart depicting steps of an imaging device method.

The operation of some imaging device embodiments may be explained with reference to FIG. 4. In these embodiments, menu data is received 40 from a remote computing device (not shown in FIG. 3), which is connected to the imaging device 30 via the communication link 38 through a wired or wireless connection. This menu data is then displayed 42 on the imaging device user interface display 36. This display of remote menu data is intended to prompt a user to make an input on the user interface input device 34.

Imaging devices of these embodiments are further configured to accept input from a user in response to a display of remote menu data and communicate 44 that user input to a remote computing device. In some embodiments, this user input data will be processed by a remote computing device. This may comprise running an application on the remote computing device. This processing may also comprise accessing and communicating data that is stored on the remote computing device.

The imaging devices of these embodiments are further configured to receive 46 data resulting from processing the user input data. This may comprise data generated by an application running on the remote computing device in response to the user input. The imaging device may also receive data that was stored on a remote computing device, such as a file server, in response to processing the user input.

Once the imaging device 30 has received 46 the processed data, the imaging device 30 may perform 48 a native function in response to the data or using the data. For example, and not be way of limitation, the imaging device 30 may print a document that was stored on the remote computing device and modified on the remote computing device according to the user input. As another non-limiting example, the imaging device 30 may active or enable functions (i.e., scanning, copying, printing, fax transmission) on the imaging device in response to the receipt 46 of processed data.

Figure 5:
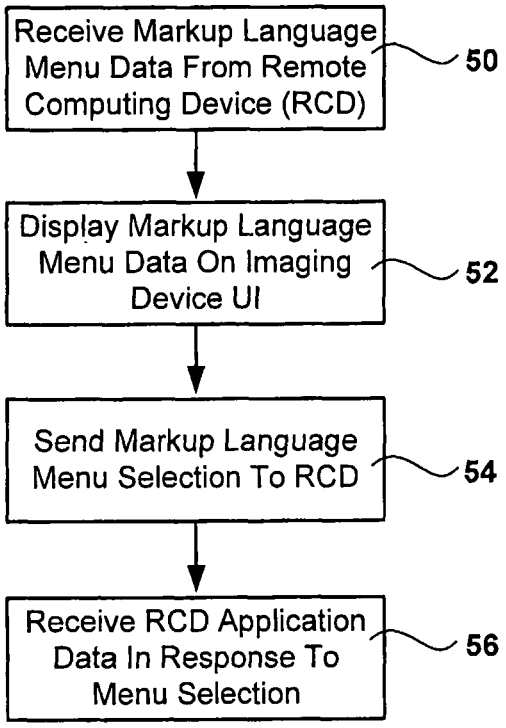
FIG. 5 is a chart depicting steps of an imaging device method using a markup language.

Some, more specific, imaging device embodiments may be explained with reference to FIG. 5. In these embodiments, the imaging device 30 is configured to receive 50 menu data formatted in a markup language from a remote computing device. The communication link by which the menu data is communicated may be established and maintained using a Hypertext Transfer Protocol (HTTP). The markup language may comprise terms from Hypertext Markup Language (HTML), Extensible Markup Language (XML), Wireless Markup Language (WML), Extensible Hypertext Markup Language (XHTML) and/or other languages.

Once the menu data is received 50, it may be displayed 52 on the imaging device user interface display 36. As in previously described embodiments, the menu data is typically intended to prompt user input on imaging device user interface 32. Display 52 of the remotely-stored menu data may be accomplished with a browser application that is native to the imaging device 30.

In these embodiments, the imaging device 30 is further configured to route 54 user input received through its user interface 32 to a remote computing device. The remote computing device that receives the user input may then run an application or otherwise process the user input and return the results of the processing to the imaging device 30. Accordingly, the imaging device 30 is further configured to receive 56 processed data from a remote computing device. In some embodiments, the imaging device 30 may perform one or more functions in response to the receipt 56 of processed data.

Figure 6:
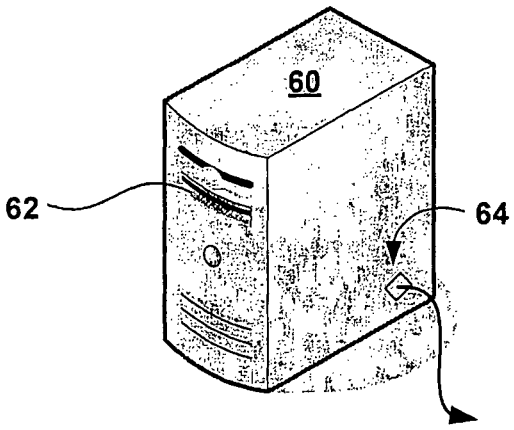
FIG. 6 shows an exemplary remote computing device embodiment.

Some embodiments of the present invention may be explained with reference to FIG. 6. These embodiments comprise a remote computing device (RCD) 60, which has a communications link 64. Communications link 64 may be a wired connection (as shown in FIG. 6) comprising a network cable, a Universal Serial Bus (USB) cable, a serial cable, a parallel cable, a powerline communication connection such as a HomePlug connection or other wired connections. Alternatively, the communications link 64 may comprise a wireless connection, such as an IEEE 802.11(b) compliant connection, a Bluetooth connection, an Infrared connection, such as those defined in the Infrared Data Association (IrDA) standard or some other wireless connection. In some embodiments, RCD 60 may further comprise a data storage device 62, which is typically a hard drive, but may also be an optical drive device, such as an array of compact disk drives, flash memory or some other storage device.

Figure 7:
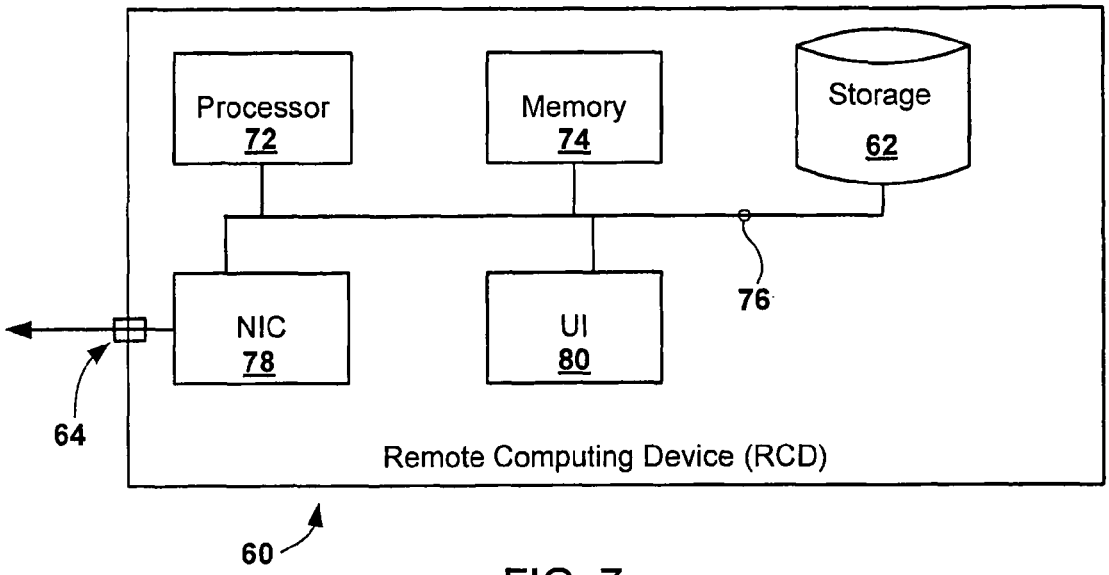
FIG. 7 is a diagram showing components of an exemplary remote computing device.

Embodiments of RCD 60 may be further described with reference to FIG. 7. In these embodiments, RCD 60 comprises a processor 72 for processing data and running programs such as operating systems and applications. RCD 60 may further comprise memory 74, which may be in the form of Random Access Memory (RAM) and Read Only Memory (ROM). Generally, any applications processed by processor 72 will be loaded into memory 74. RCD 60 may further comprise a network interface 78, which allows RCD 60 to communicate with other devices, such as an imaging device 30. In some embodiments, RCD 60 may also comprise a user interface 80, but this is not required in many embodiments. Storage 62 may be used to store applications and data that may be accessed by an imaging device 30 of embodiments of the present invention. Processor 72, memory 74, storage 62, network interface 78 and, optionally, user interface 80 are typically linked by a system bus 76 to enable data transfer between each component. Communications link 64 may couple the RCD 60 to other devices via network interface 78.

Figure 8:
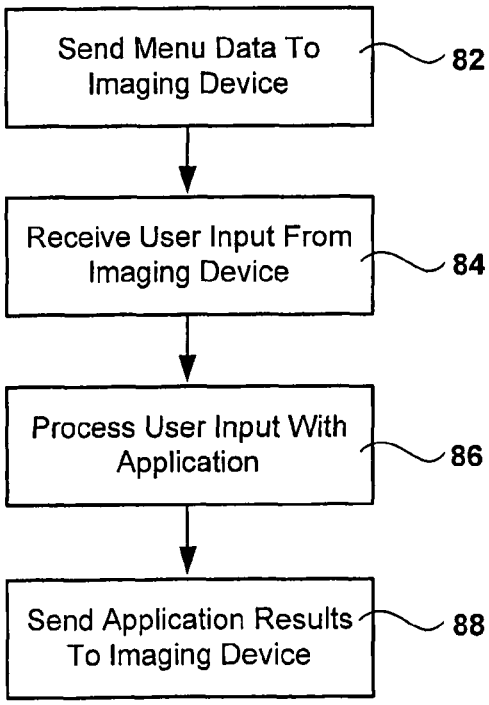
FIG. 8 is a chart showing steps of a remote computing device method.

In some embodiments, described with reference to FIG. 8, an RCD 60 may comprise menu data stored on storage device 62 or in memory 74. This menu data may be configured for display on an imaging device user interface 32. Menu data may be stored in many formats and configurations. In some embodiments menu data may take the form of terms expressed with a markup language. The markup language may comprise terms from Hypertext Markup Language (HTML), Extensible Markup Language (XML), Wireless Markup Language (WML), Extensible Hypertext Markup Language (XHTML) and/or other languages. In these embodiments, menu data may be sent 82 through a communications link 64 to an imaging device 30. Accordingly, menu data configured for display on an imaging device is stored on RCD 60.

An RCD 60, of some embodiments, will be further configured to receive 84 user input obtained through the user interface 32 of an imaging device 30 and transferred to the RCD 60 over communications links 38 & 64. Once this input data is received at an RCD 60, the input data may be processed 86. This processing 86 may comprise conversion of the data to a new format, execution of commands contained within the data or some other process. Once the input data has been processed 86, the processed output may be sent 88 back to the imaging device 30 where the processed output may be used in an imaging device process or function.

Figure 9:
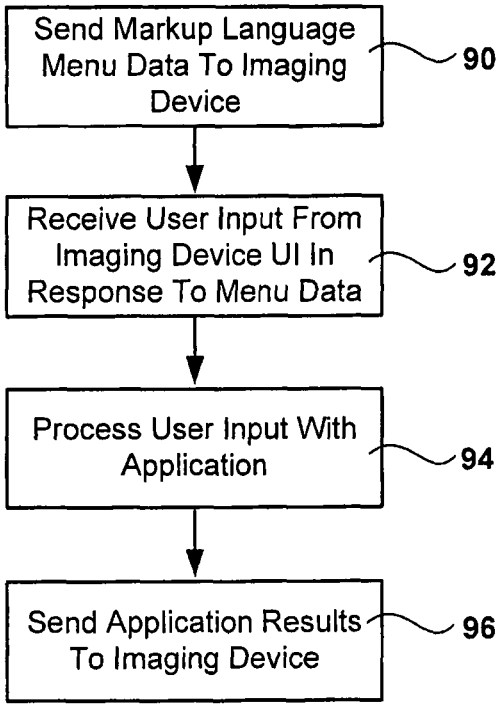
FIG. 9 is a chart showing steps of a remote computing device method using a markup language.

In some embodiments, as described with reference to FIG. 9, an RCD 60 may send 90 menu data configured for an imaging device display 36 using a markup language. The markup language menu data is then received at the imaging device 30 and displayed to a user. Typically, this will prompt the user to enter an input on the imaging device user interface 32. This user input will then be sent by the imaging device 30 to the RCD 60. The RCD 60 will then receive 92 the input data prompted by the display of the menu data on the imaging device 30. Once received, the input data may be processed 94 on the RCD 60. Processing may comprise the selection, recordation and/or modification of a form, document or other data stored on RCD 60, the authorization of a user identified by the user input, the translation of a document input by the user, generation of a map or other directions related to user input or some other process or function.

Figure 10:
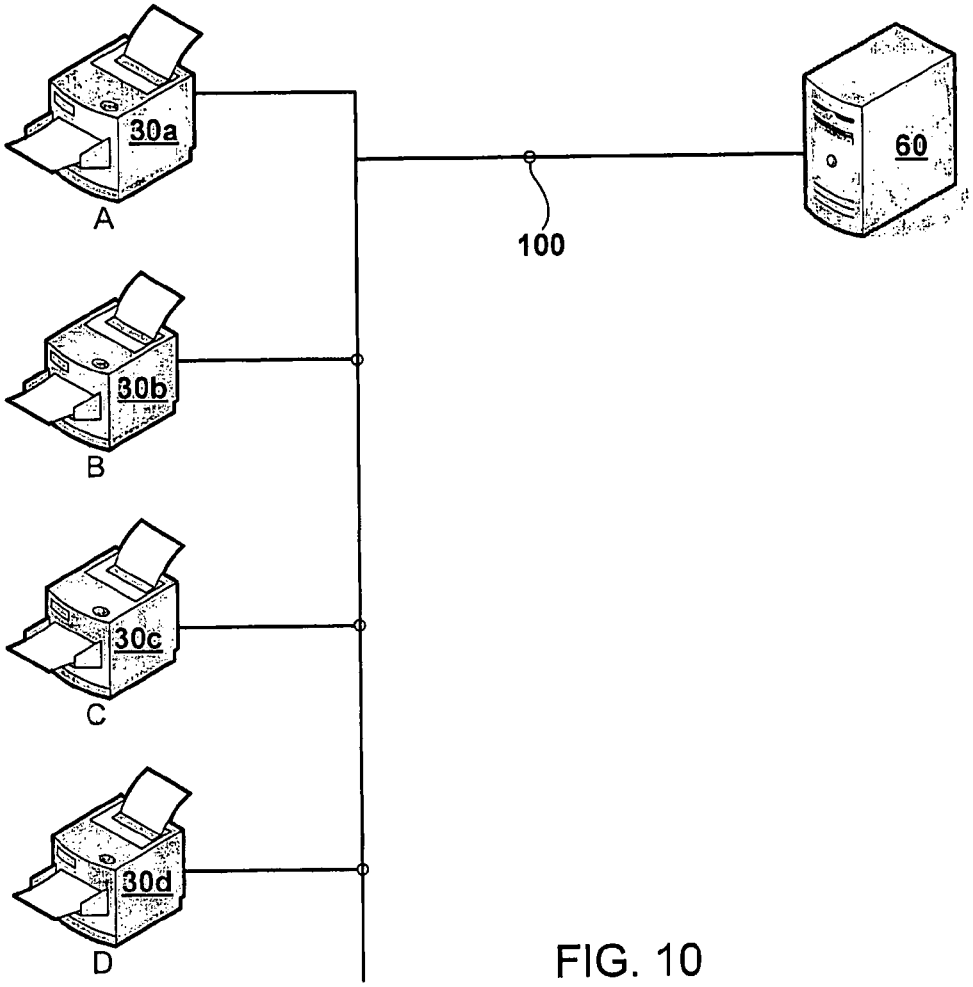
FIG. 10 is a diagram showing a system comprising multiple imaging devices in connection with a remote computing device.
Figure 11:
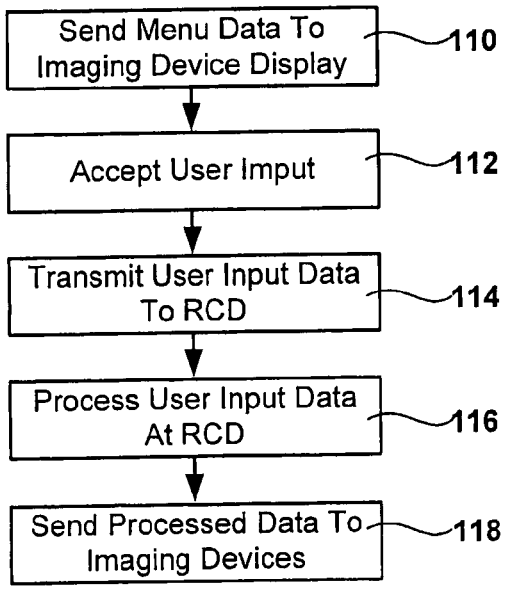
FIG. 11 is a chart showing steps of a method that may be employed by the system depicted in FIG. 10.

Some embodiments of the present invention may be described with reference to FIGS. 10 & 11. These embodiments comprise at least one RCD 60 and a plurality of imaging devices 30*a*-30*d*. In these embodiments, at least one of the imaging devices 30*a*-30*d* comprises a user interface 32 with a display 36 and user input panel 34 that is integral with the display (i.e., touch-screen) or a separate input unit. RCD 60 is connected to imaging devices 30*a*-30*d* by a communications link and network 100 to enable data transmission between RCD 60 and imaging devices 30*a*-30*d*.

In these embodiments, menu data is stored on RCD 60 and sent 110 to at least one of the imaging devices 30*a*-30*d* where the menu data is displayed on a user interface. Any of Imaging devices 30*a*-30*d* that receive the menu data are configured to accept 112 and transmit 114 user input to an RCD 60. Once the user input data is received at the RCD, the data may be processed 116 as discussed in previously described embodiments. The result of processing 116 may then be sent 118 back to any combination of the imaging devices 30*a*-30*d*.

In these embodiments, a single RCD 60 may be used to provide processing power, resources and functionality to a plurality of imaging devices 30*a*-30*d* without reproducing these resources in each imaging device. In some embodiments, data generated by input on one imaging device 30*a* may be directed to another imaging device 30*d* for processed data output or final processing.

Figure 12:
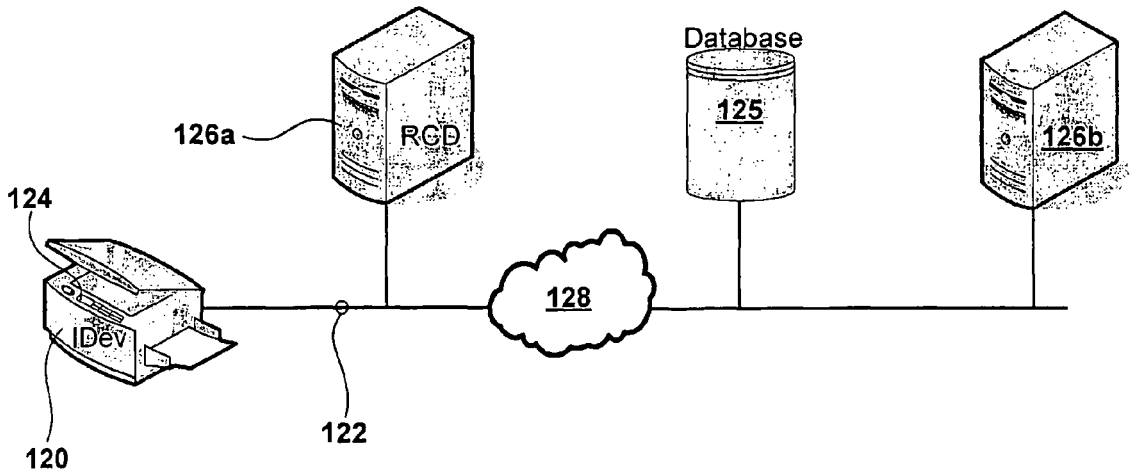
FIG. 12 is a diagram showing components of some embodiments comprising multiple RCDs and linked resources.

Some embodiments of the present invention may be described with reference to FIG. 12. In these embodiments, an imaging device (IDev) 120 comprises a user interface (UI) 124, which is capable of receiving user input and displaying data to a user. The user interface 124 will typically comprise a display, often in the form of a touch panel. The display may be used to display data to a user. This data may comprise menu data to prompt for a user selection or data entry, such as a user ID and password, form selection or some other input. This data may be supplied to the UI from an RCD 126*a*, 126*b* or 126*c*, from the device itself 120, from a networked database 125 or from some other location accessible to the IDev 120 via a communications link such as a network 122. The imaging device 120 has a communication link 122, which may comprise a typical computer network connection, a serial cable or some other wired or wireless communication link as described in other embodiments. The communication link 126 connects the imaging device 120 to a remote computing device (RCD) 128, such as a server. The RCD 128 may be used to store documents, such as forms, and other data and make that data accessible from the imaging device 120. The RCD 128 may also execute applications that interact with or receive input from the imaging device 120 and its user interface 124. In some embodiments, an RCD 126*a*-126*c* may comprise accounting and control functions that may authenticate a user, authorize IDev 120 usage, and enable IDev 120 functions based on a user status, such as a user's account balance or credit availability. Parts of these functions may be performed on different RCDs 126*a*-126*c*, via database access 125 or through other network devices.

Peripheral Device Accounting and Access

Embodiments of the present invention comprise systems and methods for peripheral device accounting and access. Peripheral devices comprise printers, scanners, copiers, plotters, facsimile machines, and other devices that may be connected to communicate with computing devices through a communication link, such as a network connection. Some peripheral devices comprise multiple functions. Multiple function peripherals may be referred to as MFPs. A common type of MFP comprises a printer, scanner and facsimile machine and may perform copier functions using the scanner and printer functionality. Other MFPs have different combinations of functions.

Some peripheral devices may be used in a commercial environment where users pay a fee to use the various peripheral device functions. A common scenario comprises an MFP connected to an accounting system, which keeps track of functions performed by a user and calculates a fee to be paid by the user for the functions performed. This scenario may employ a debit, credit or some other accounting system for billing purposes. The following paragraphs describe exemplary embodiments of accounting-enabled peripheral devices.

Figure 13:
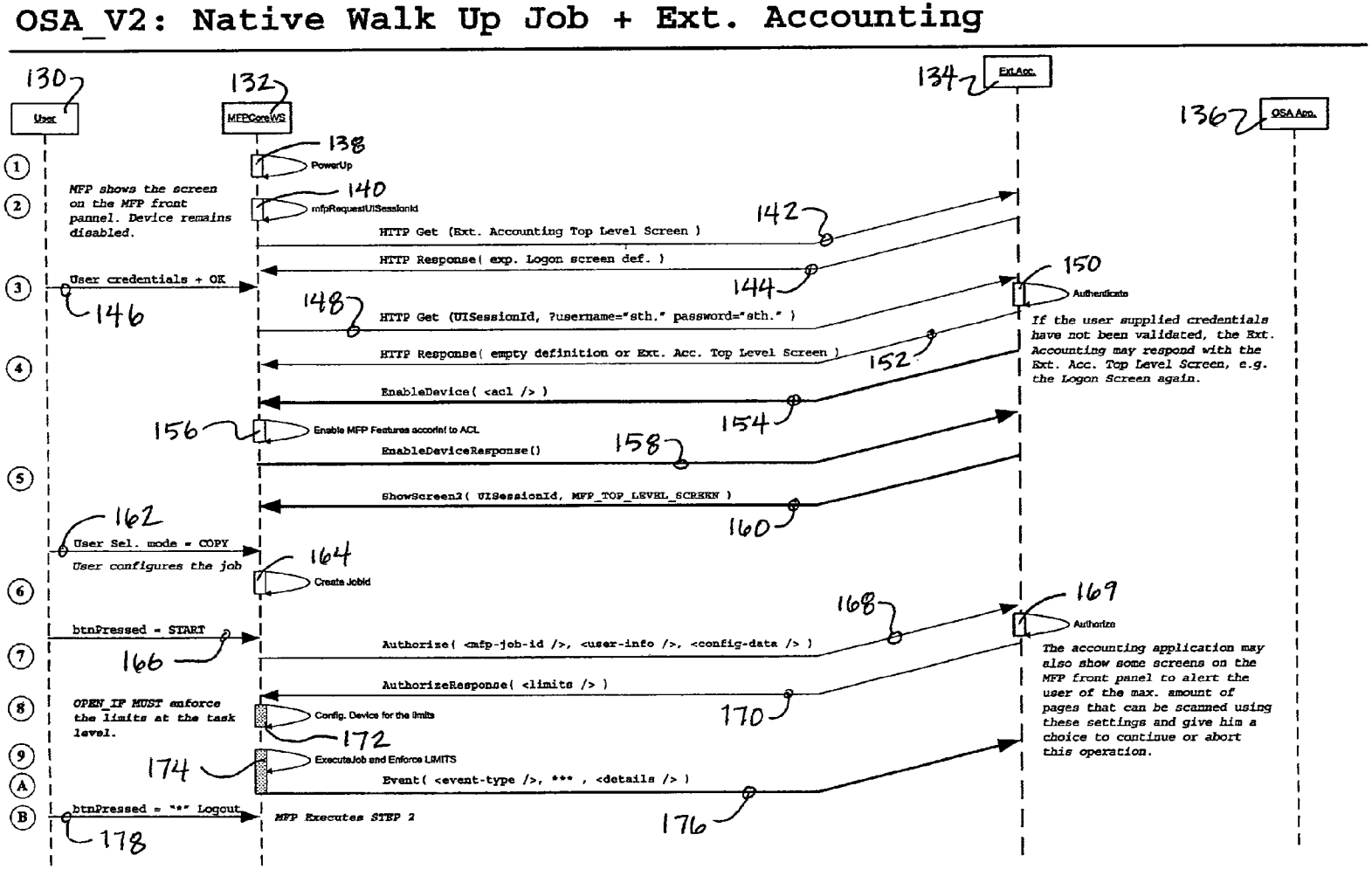
FIG. 13 is a diagram showing embodiments comprising external accounting for a native walk up job.

Some embodiments of the present invention may be described with reference to FIG. 13. These embodiments comprise a multi-function peripheral (MFP) 132 that is connected via a communications link to an RCD 134, which performs external accounting functions. In this diagram, user input is shown as actions from a user 130. In these embodiments, a user 130 is present at the MFP 132 and provides input thereto via a user interface (UI). In these exemplary embodiments, the MFP 132 comprises a Web Service that enables communication through HTTP calls.

In a typical use scenario, the MFP 132 is powered up 138 and, during a "boot up" phase, the MFP 132, requests 142 a menu to be displayed on the device UI. The menu may be supplied by an RCD 134 or may be stored on the MFP 132 itself. The menu may be requested with an HTTP Get call and supplied with an HTTP Response. If the menu is supplied from an RCD 134, the RCD 134 will respond to the request and transmit 144 a menu to the MFP 132 for UI display. A user 130 may then input user credentials 146, such as a user ID or authorization code that will identify the user 130 and an associated account.

Once a user 130 has input credentials 146, the user ID/account ID is transmitted 148 to the external accounting RCD 134, which may then authenticate 150 the user/account, by verifying that the user is a valid, approved user. If the user is not authenticated, the MFP will remain in a disabled state. Once authentication 150 has been successfully completed, the external accounting RCD 134, may send a successful authentication message 152 to the MFP 132, which may be displayed to the user 130. Upon successful authentication, 150, the external accounting RCD 134 may also send an enabling message 154 to the MFP 132. This message 154 may contain commands that activate specific functions on the MFP 132 and provide menu content to allow a user to select functionality that is not available before authentication.

When the enabling message 154 is received at the MFP 132, the MFP may perform enabling functions 156 that provide enhanced access to MFP functions. Authentication 150 may also link the user's requests to a user account that may employ a debit, credit or other payment system. When enabling functions 156 need to be performed at the MFP 132, a device enabled message 158 may be sent back to the external accounting RCD 134 to indicate that the MFP 132 is now enabled and ready for further content. The external accounting RCD 134 may respond 160 to the enabled message 158 with additional menus or other commands, content or other data.

When the MFP 132 is enabled and menus and other content are provided to the device UI, a user 130 may select 162 an MFP function and designate function parameters through a UI or otherwise. The MFP 132 may respond to this selection 162 by creating a job ID 164 and description, which may, in some embodiments, be presented to a user 130 for confirmation. If confirmation 166 is received, the job ID/description is transmitted 168 to the external accounting RCD 134 for authorization. In some embodiments of the present invention, authorization 169 may comprise account management wherein the fees associated with the job description are compared to a user account status to verify that sufficient finds are available, sufficient credit is authorized or some other status. If the account status is acceptable for the specific job identified in the job description/ID, the job may be authorized and an authorization message 170 may be sent to the MFP 132 to authorize the job within the limits of the account status. Job limits may comprise a number of copies or iterations of a job that are allowed by the account status. In some embodiments, a counter may count down from the authorized limit until it reaches zero. At this point, the job authorization will be terminated and the job execution will stop. If the account status is not acceptable, the job may not be authorized and the user may be prompted to change the account status or modify the job description.

When a job is authorized and the authorization message 170 is received, the MFP 132 may proceed to configure itself 172 for the job and execute 174 the job. After job completion, a job completion event message 176 may be sent to the external accounting RCD 134. This message may inform the RCD 134 that the job is complete and may trigger accounting functions that debit, use credit or otherwise account for the job completion in the user's account. In addition to informing the RCD that the job is complete, the completion event message 176 may provide additional information about the job so that the RCD 134 may determine how to charge an account. After a job is complete, a user 130 may manually log out 178 to disable further use of the user's account or the account may be disabled automatically, such as a log out after a specified timeout period. When a user logs out, either manually or through an automated process, a login UI may be automatically displayed on the MFP 132.

Figure 14:
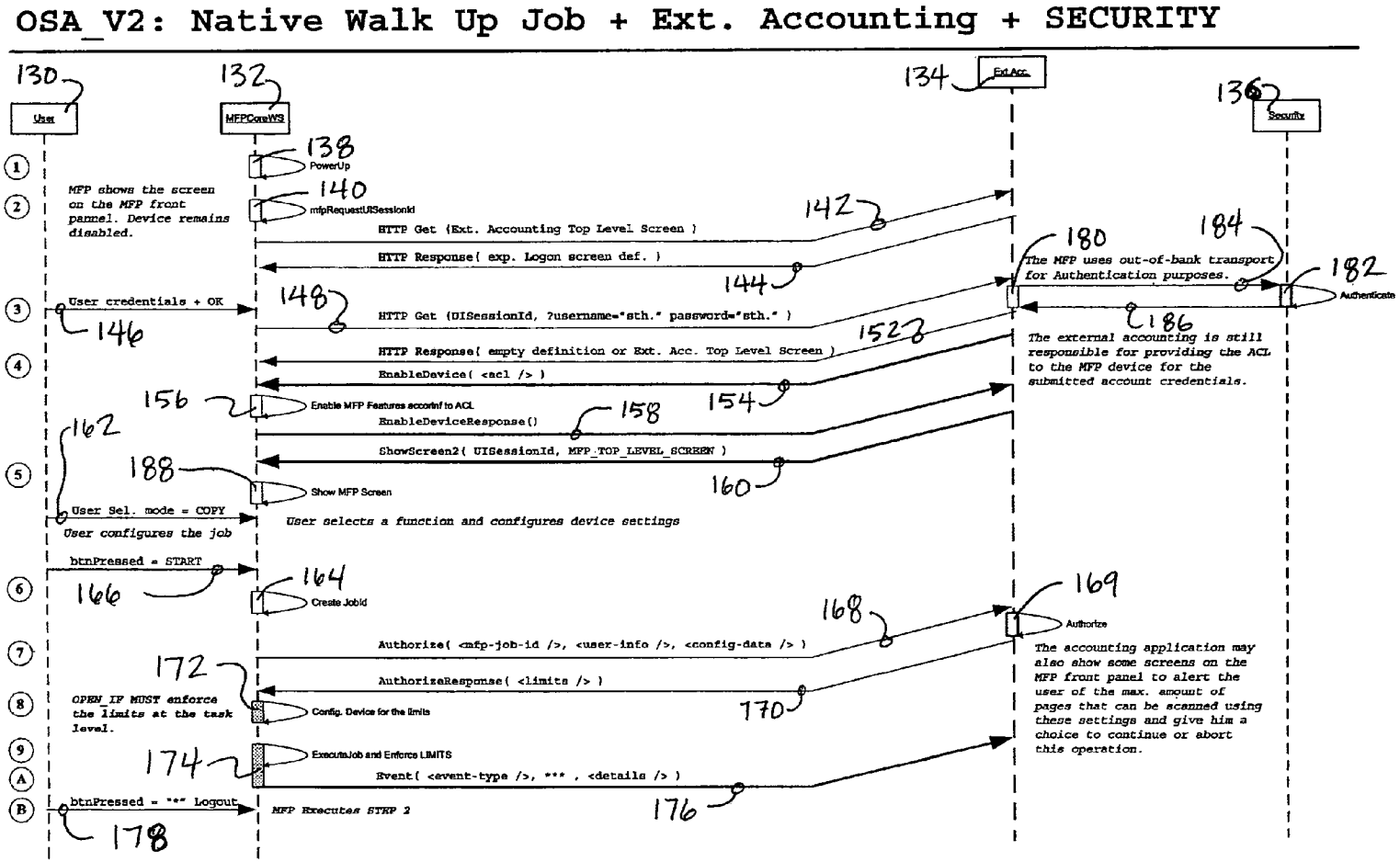
FIG. 14 is a diagram showing embodiments comprising external accounting and external security for a native walk up job.

Some embodiments of the present invention may be described with reference to FIG. 14. These embodiments comprise a multi-function peripheral (MFP) 132 that is connected via a communications link to an RCD 134, which performs external accounting functions. In these embodiments, a user 130 is present at the MFP 132 and provides input thereto via a user interface (UI). In these exemplary embodiments, the MFP 132 comprises a Web Service that enables communication through HTTP calls, however, other methods may be used.

In a typical use scenario, the MFP 132 is powered up 138 and, during a "start up" phase, the MFP 132, requests 142 a menu to be displayed on the device UI. The menu may be supplied by an RCD 134 or may be stored on the MFP 132 itself. The menu may be requested with an HTTP Get call and supplied with an HTTP Response. If the menu is supplied from an RCD 134, the RCD 134 may respond to the request and transmit 144 a menu to the MFP 132 for UI display. A user 130 may then input user credentials 146, such as a user ID or authorization code that will identify the user 130 and an associated account.

Once a user 130 has input credentials 146, the user ID/account ID is transmitted 148 to an external accounting RCD 134. In these exemplary embodiments, the accounting RCD 134 processes the user/account data and sends it to a remote security device 136, such as a security server/database. The security device 136 may then authenticate the user or account to verify that the user is a valid, approved user. If the user is not authenticated 182, the security device will not send a response notifying the accounting RCD 134 to enable the peripheral device 132 and the MFP 132 will remain in a disabled state. If authentication 182 is successfully completed, the security device 136, will notify 186 the accounting RCD 134 of the authentication. The external accounting RCD 134, may then send a successful authentication message 152 to the MFP 132, which may be displayed to the user 130. Upon successful authentication, 150, the external accounting RCD 134 may also send an enabling message 154 to the MFP 132. This message 154 may contain commands that activate specific functions on the MFP 132 and provide menu content to allow a user to select functionality that is not available before authentication.

When the enabling message 154 is received at the MFP 132, the MFP may perform enabling functions 156 that provide enhanced access to MFP functions. Authentication 150 may also link the user's requests to a user account that may employ a debit, credit or other payment system. When enabling functions 156 need to be performed at the MFP 132, a device enabled message 158 may be sent back to the external accounting RCD 134 to indicate that the MFP 132 is now enabled and ready for further content. The external accounting RCD 134 may respond 160 to the enabled message 158 with additional menus or other commands, content or other data. This additional content 160 may be displayed 188 to a user.

When the MFP 132 is enabled and menus and other content are provided to the device UI, a user 130 may select 162 an MFP function and designate function parameters through a UI or otherwise. Confirmation of the job parameters may be communicated 166 by the user and a job ID/description may be created 164 and transmitted 168 to the external accounting RCD 134 for authorization. In some embodiments of the present invention, authorization 169 may comprise account management wherein the fees associated with the job description are compared to a user account status to verify that sufficient funds are available, sufficient credit is authorized or some other status. If the account status is acceptable for the specific job identified in the job description/ID, the job may be authorized and an authorization message 170 may be sent to the MFP 132 to authorize the job within the limits of the account status. Job limits may comprise a number of copies or iterations of a job that are allowed by the account status. In some embodiments, a counter may count down from the authorized limit until it reaches zero. At this point, the job authorization will be terminated and the job execution will stop. If the account status is not acceptable, the job may not be authorized and the user may be prompted to change the account status or modify the job description.

When a job is authorized and the authorization message 170 is received, the MFP 132 may proceed to configure itself 172 for the job and execute 174 the job. After job completion, a job completion event message 176 may be sent to the external accounting RCD 134. This message may inform the RCD 134 that the job is complete and may trigger accounting functions that debit, use credit or otherwise account for the job completion in the user's account. In addition to informing the RCD that the job is complete, the completion event message 176 may provide additional information about the job so that the RCD 134 may determine how to charge an account. After a job is complete, a user 130 may manually log out 178 to disable further use of the user's account or the account may be disabled automatically, such as a log out after a specified timeout period. When a user logs out, either manually or through an automated process, a login UI may be automatically displayed on the MFP 132.

Figure 15A:
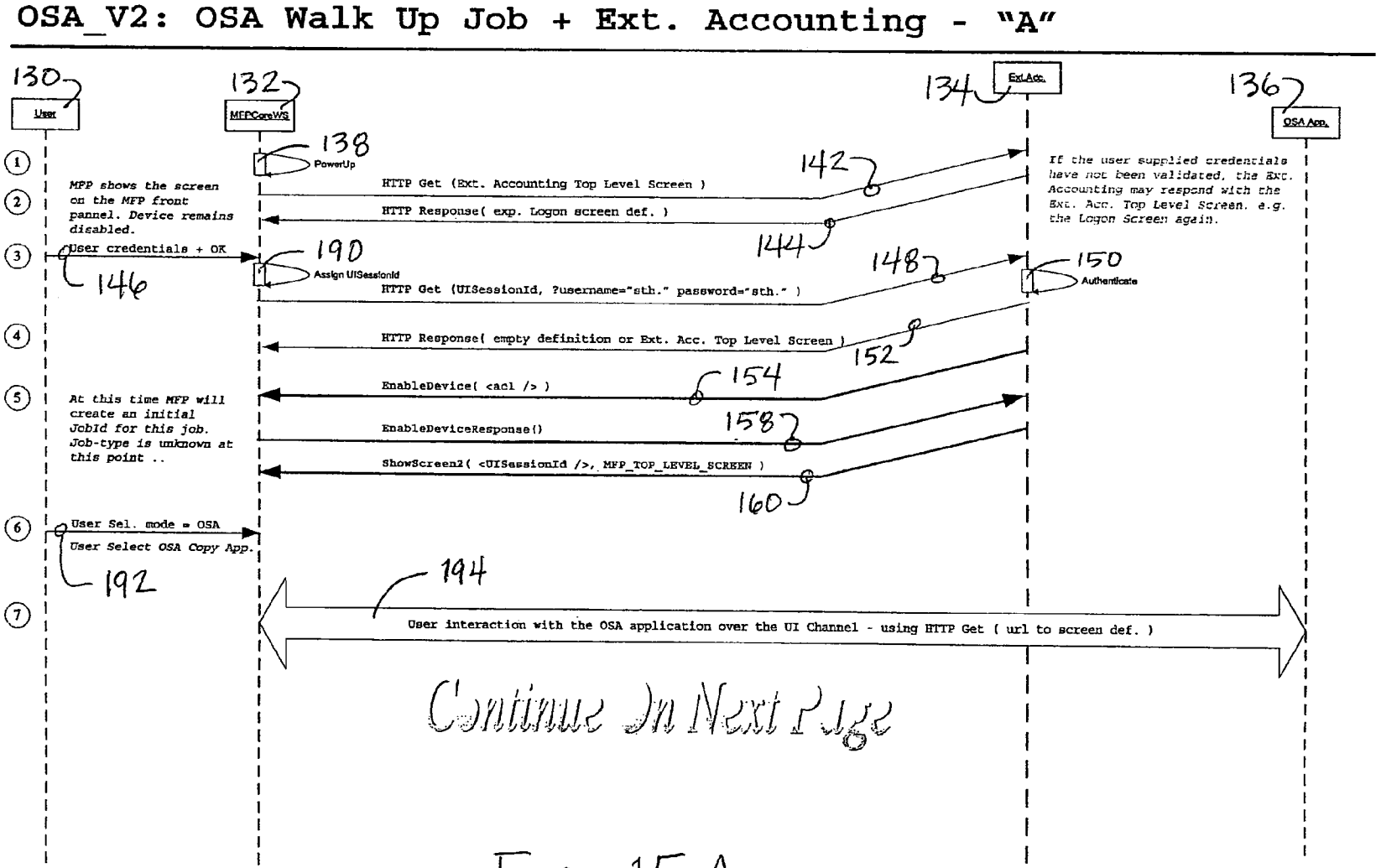
FIG. 15A is a diagram showing embodiments comprising external accounting for a walk up job wherein a remote application provides job functionality.
Figure 15B:
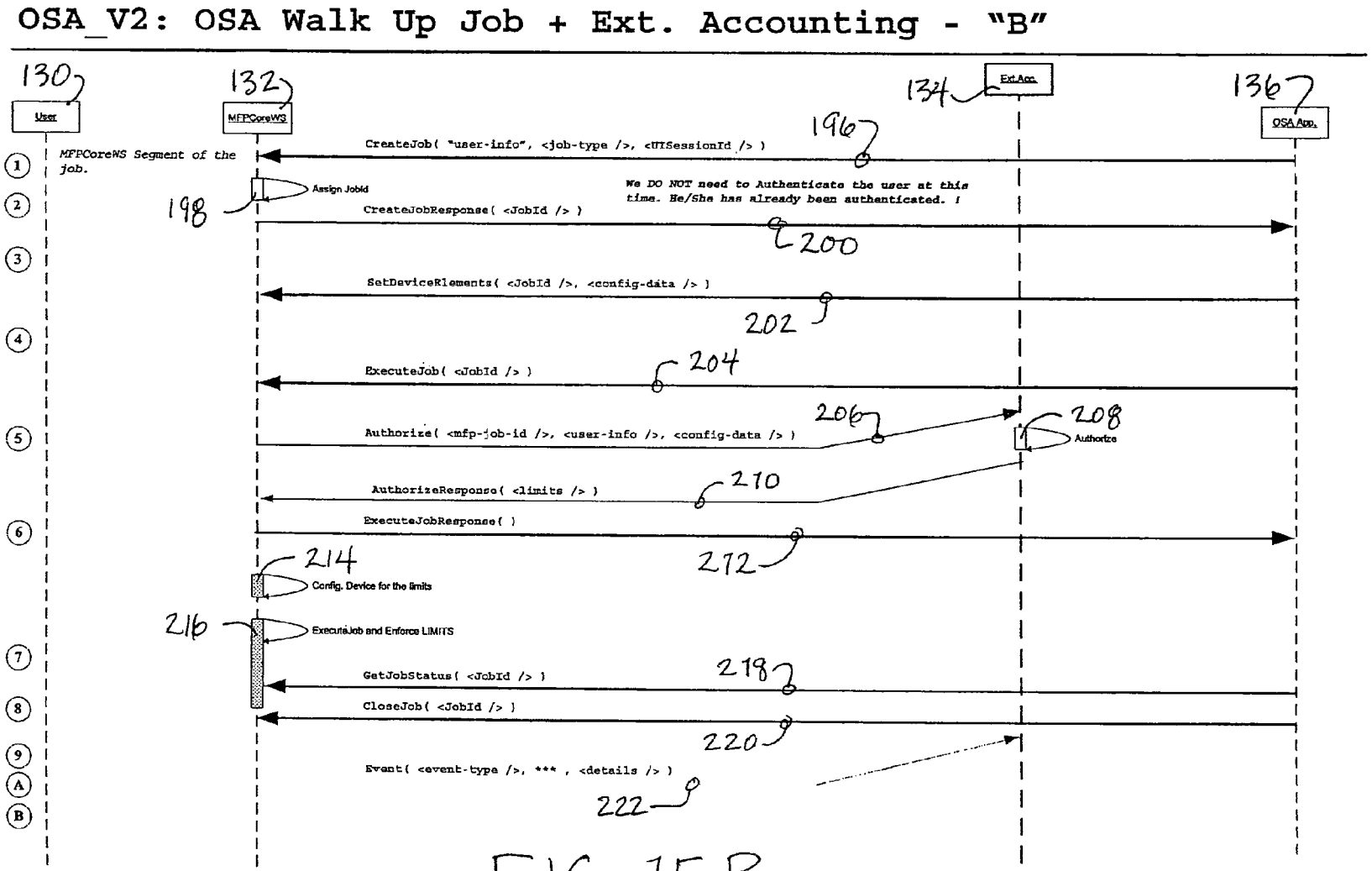
FIG. 15B is a continuation of the diagram of FIG. 15A.

Some embodiments of the present invention may be described with reference to FIGS. 15A and 15B. These embodiments comprise a multi-function peripheral (MFP) 132 that is connected via a communications link to an RCD 134, which performs external accounting functions. In these embodiments, a user 130 is present at the MFP 132 and provides input thereto via a user interface (UI). In these exemplary embodiments, the MFP 132 comprises a Web Service that enables communication through HTTP calls, however, other methods may be used.

In a typical use scenario, the MFP 132 is powered up 138 and, during a "start up" phase, the MFP 132, requests a menu to be displayed on the device UI. The menu may be supplied by an RCD 134 or may be stored on the MFP 132 itself. The menu may be requested with an HTTP Get call and supplied with an HTTP Response. If the menu is supplied from an RCD 134, the RCD 134 may respond to the request and transmit 144 a menu to the MFP 132 for UI display. A user 130 may then input user credentials 146, such as a user ID or authorization code that will identify the user 130 and an associated account.

Once a user 130 has input credentials 146, a UI session may be initiated and the user ID/account ID may be transmitted 148 to the external accounting RCD 134, which may then authenticate 150 the user/account, by verifying that the user is a valid, approved user. If the user is not authenticated, the MFP will remain in a disabled state. Once authentication 150 has been successfully completed, the external accounting RCD 134, may send a successful authentication message 152 to the MFP 132, which may be displayed to the user 130. Upon successful authentication, 150, the external accounting RCD 134 may also send an enabling message 154 to the MFP 132. This message 154 may contain commands that activate specific functions on the MFP 132 and provide menu content to allow a user to select functionality that is not available before authentication.

When the enabling message 154 is received at the MFP 132, the MFP may perform enabling functions that provide enhanced access to MFP functions. Authentication 150 may also link the user's requests to a user account that may employ a debit, credit or other payment system. A device enabled message 158 may be sent back to the external accounting RCD 134 to indicate that the MFP 132 is now enabled and ready for further content. The external accounting RCD 134 may respond 160 to the enabled message 158 with additional menus or other commands, content or other data.

When the MFP 132 is enabled and menus and other content are provided to the device UI, a user 130 may select 192 an MFP function and designate function parameters through a UI or otherwise. The MFP 132 may then open a user interaction channel to a second remote computing device (RCD2) 136 on which applications, menu content and other data may reside. RCD2 136 may comprise a multi-layer menu structure or some other access mechanism that adds significant functionality to the MFP 132. RCD2 136 may comprise language translation functions, mapping functions and many other functions.

Applications running on RCD2 136 my access MFP 132 directly 196 using Web Services and HTTP calls or using some other protocol or method. A remote application on RCD2 136 may create a job through connection 196. When this occurs, MFP 132 may create a job ID 198 to identify the job. Once created, the job ID may be communicated back to the RCD2 application. An application on RCD2 136 may then respond 202 with device configuration data and job parameters. Once the job is fully configured, RCD2 may request 204 execution of the job. This request is typically followed by an authorization procedure to ensure that the user's account status will support the job.

Authorization may be initiated by a request from the MFP 132 to an external accounting RCD 134. In some embodiments of the present invention, authorization 208 may comprise account management wherein the fees associated with the job description are compared to a user account status to verify that sufficient funds are available, sufficient credit is authorized or some other status. If the account status is acceptable for the specific job identified in the job description/ID, the job may be authorized and an authorization message 210 may be sent to the MFP 132 to authorize the job within the limits of the account status. Job limits may comprise a number of copies or iterations of a job that are allowed by the account status. In some embodiments, a counter may count down from the authorized limit until it reaches zero. At this point, the job authorization will be terminated and the job execution will stop. If the account status is not acceptable, the job may not be authorized and the user may be prompted to change the account status or modify the job description.

When a job is authorized and the authorization message 210 is received, the MFP 132 may notify 212 any application on RCD2 136 of the authorization status and proceed to configure itself 214 for the job and execute 216 the job. RCD2 136 may query 218 the MFP 132 for a job status and close 220 the job when appropriate. After job completion, a job completion event message 222 may be sent to the external accounting RCD 134 and/or application RCD2 136. This message may inform the RCDs that the job is complete and may trigger accounting functions that debit, use credit or otherwise account for the job completion in the user's account. After a job is complete, a user 130 may manually log out to disable further use of the user's account or the account may be disabled automatically, such as a log out after a specified timeout period. When a user logs out, either manually or through an automated process, a login UI may be automatically displayed on the MFP 132.

Figure 16:
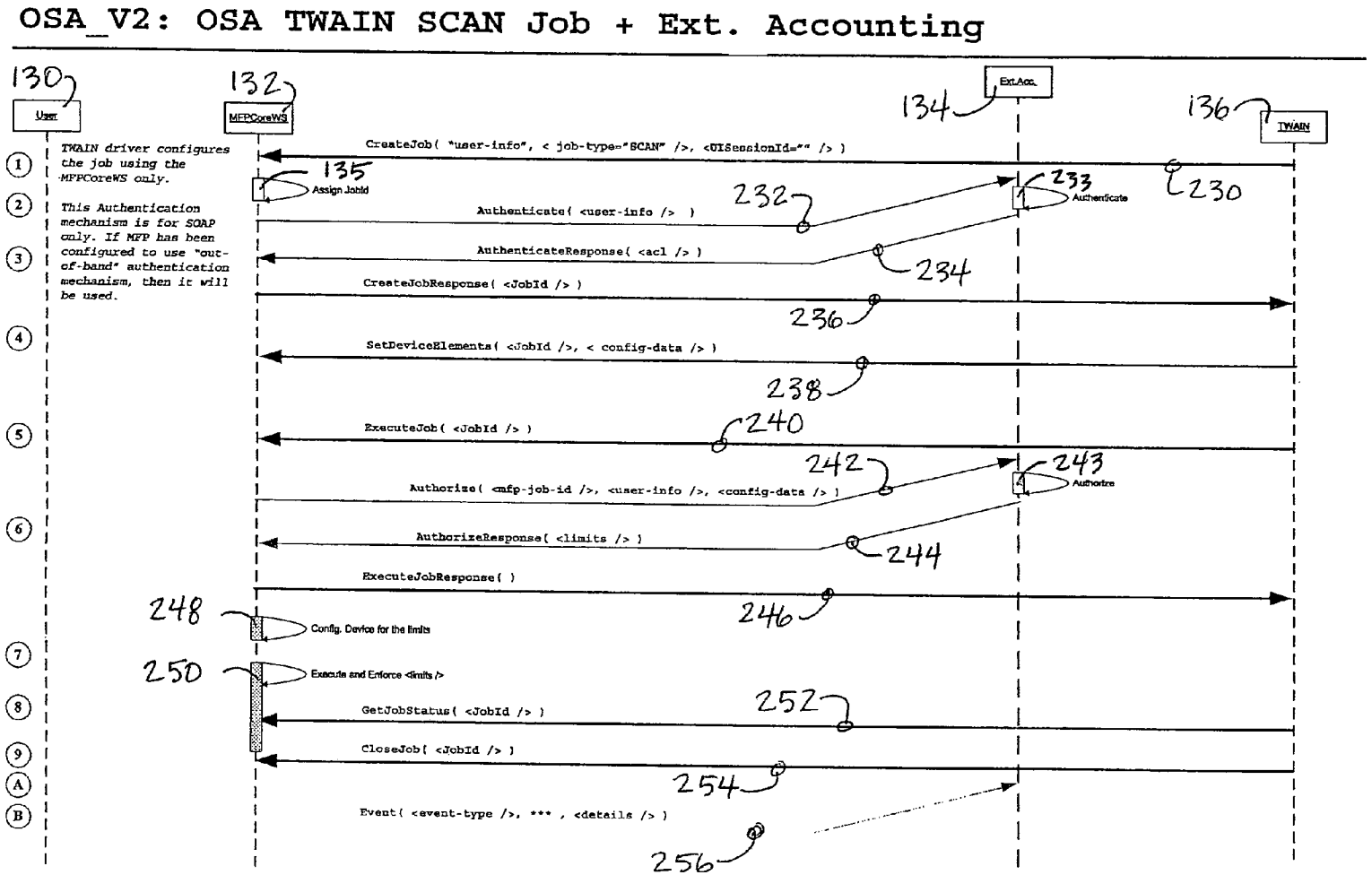
FIG. 16 is a diagram showing embodiments comprising external accounting for an exemplary scan job originating on an RCD.

Some embodiments of the present invention may be described with reference to FIG. 16. These embodiments comprise a multi-function peripheral (MFP) 132 that is connected via a communications link to an RCD 134, which performs external accounting functions. In these exemplary embodiments, the MFP 132 may comprise a Web Service that enables communication through HTTP calls.

In these embodiments a second remote computing device (RCD2) 136 may comprise applications, menu content and other data and functions for MFP 132. In some exemplary embodiments, RCD2 comprises a driver, such as a TWAIN driver that interacts with MFP 132.

In a typical use scenario, a user initiates a scan job or some other job using a driver on RCD2 136. The RCD2 136 driver may then send 230 job configuration data and user information to MFP 132. When this is received, MFP 132 may assign 135 a job ID.

User credentials such as user ID and account ID data may be embedded in the scan job request. When this data is obtained by MFP 132, it may be transmitted 232 to the external accounting RCD 134, which may then authenticate 233 the user/account, by verifying that the user is a valid, approved user. If the user is not authenticated, the MFP may remain in a disabled state. Once authentication 233 has been successfully completed, the external accounting RCD 134, may send a successful authentication message 234 to the MFP 132, which may be displayed to the user 130. When the MFP 132 receives a successful authentication confirmation 234, the MFP 132 may notify 236 the driver on RCD2 136 of the successful authentication and the RCD2 driver may respond 238 with device configuration commands and job data. Once the job is configured on the MFP 132, a driver may request 240 job execution.

The job must be authorized before execution so the MFP 132 may send job configuration data to external accounting RCD 134 for authorization. In some embodiments of the present invention, authorization 243 may comprise account management wherein the fees associated with the job description are compared to a user account status to verify that sufficient funds are available, sufficient credit is authorized or some other status. If the account status is acceptable for the specific job identified in the job description/ID, the job may be authorized and an authorization message 244 may be sent to the MFP 132 to authorize the job within the limits of the account status. Job limits may comprise a number of copies or iterations of a job that are allowed by the account status. In some embodiments, a counter may count down from the authorized limit until it reaches zero. At this point, the job authorization will be terminated and the job execution will stop. If the account status is not acceptable, the job may not be authorized and the user may be prompted to change the account status or modify the job description.

When a job is authorized and the authorization message 244 is received, the MFP 132 may send a message 246 to the RCD2 136 driver indicating that it will proceed with job execution.

The MFP 132 may then proceed to configure itself 248 for the job and execute 250 the job. The RCD2 136 driver may request a job completion status 252 to determine when the job has been fully executed and close the job 254 when appropriate.

After job completion, a job completion event message 256 may be sent to the external accounting RCD 134. This message may inform the RCD 134 that the job is complete and may trigger accounting functions that debit, use credit or otherwise account for the job completion in the user's account. In addition to informing the RCD that the job is complete, the completion event message 176 may provide additional information about the job so that the RCD 134 may determine how to charge an account. After a job is complete, a user 130 may manually log out 178 to disable further use of the user's account or the account may be disabled automatically, such as a log out after a specified timeout period. When a user logs out, either manually or through an automated process, a login UI may be automatically displayed on the MFP 132.

Figure 17:
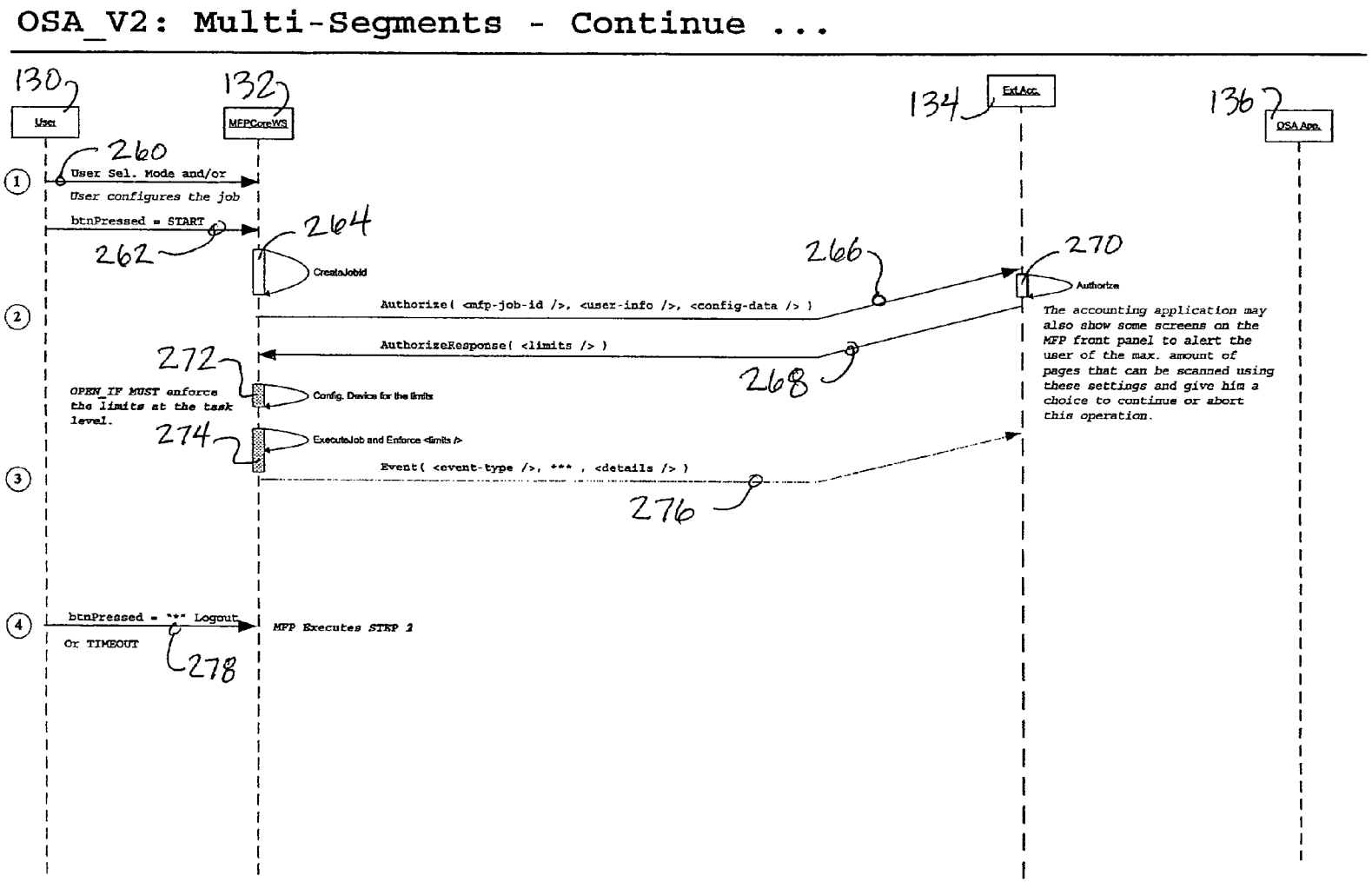
FIG. 17 is a diagram showing an extension of other embodiments to allow for additional jobs without re-authenticating a user.

Further embodiments of the present invention may be described with reference to FIG. 17. These embodiments comprise a multi-function peripheral (MFP) 132 that is connected via a communications link to an RCD 134, which performs external accounting functions. In this diagram, user input is shown as actions from a user 130. In these embodiments, a user 130 is present at the MFP 132 and provides input thereto via a user interface (UI). In these exemplary embodiments, the MFP 132 may comprise a Web Service that enables communication through HTTP calls.

In these embodiments, a user will have already submitted user ID data and will typically have completed a prior job on MFP 132. After the initial job is completed, a user may request another job without resubmitting the user ID data. In a typical use scenario, the already authenticated user may configure a job 260 and select MFP 132 functions via a user interface on an MFP 132. When a job is fully configured, a user may request job execution 262 and the MFP 132 may assign 264 a job ID.

The new job must also be authorized by the external accounting RCD 134 before execution. The MFP 132 may send 266 job configuration data to the external accounting RCD 134 for authorization. In some embodiments of the present invention, authorization 270 may comprise account management wherein the fees associated with the job description are compared to a user account status to verify that sufficient funds are available, sufficient credit is authorized or some other status. If the account status is acceptable for the specific job identified in the job description/ID, the job may be authorized and an authorization message 268 may be sent to the MFP 132 to authorize the job within the limits of the account status. Job limits may comprise a number of copies or iterations of a job that are allowed by the account status. In some embodiments, a counter may count down from the authorized limit until it reaches zero. At this point, the job authorization will be terminated and the job execution will stop. If the account status is not acceptable, the job may not be authorized and the user may be prompted to change the account status or modify the job description.

When a job is authorized and the authorization message 244 is received, the MFP 132 may then proceed to configure itself 272 for the job and execute 274 the job. After job completion, a job completion event message 276 may be sent to the external accounting RCD 134. This message may inform the RCD 134 that the job is complete and may trigger accounting functions that debit, use credit or otherwise account for the job completion in the user's account. In addition to informing the RCD that the job is complete, the completion event message 176 may provide additional information about the job so that the RCD 134 may determine how to charge an account. After a job is complete, a user 130 may manually log out 178 to disable further use of the user's account or the account may be disabled automatically, such as a log out after a specified timeout period. When a user logs out, either manually or through an automated process, a login UI may be automatically displayed on the MFP 132.

Figure 18:
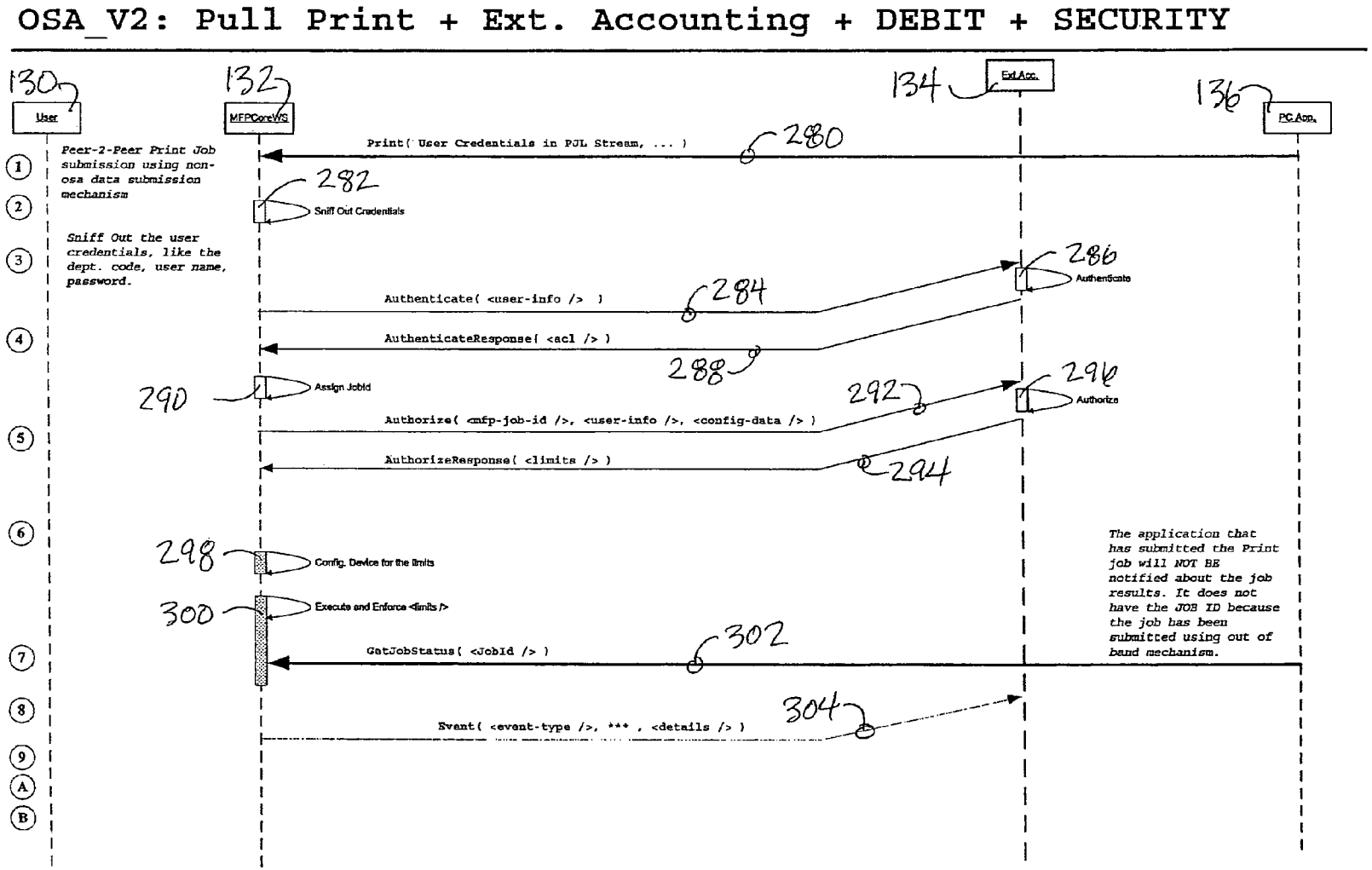
FIG. 18 is a diagram showing an exemplary print job originating on an RCD and employing external accounting and security.

Still further embodiments of the present invention may be described with reference to FIG. 18. These embodiments comprise a multi-function peripheral (MFP) 132 that is connected via a communications link to an RCD 134, which performs external accounting functions. In these exemplary embodiments, the MFP 132 may comprise a Web Service that enables communication through HTTP calls.

In these embodiments a second remote computing device (RCD2) 136 may comprise applications, menu content and other data and functions for MFP 132. In some exemplary embodiments, RCD2 may comprise an application that may create a print job.

In a typical use scenario, a user may initiate 280 a print job or some other job from an application on RCD2 136. The print job may comprise user ID and user account information. When this is received, MFP 132 may sniff out 282 the user credentials and other data from the print job.

When this data is obtained by MFP 132, it may be transmitted 284 to the external accounting RCD 134, which may then authenticate 286 the user/account, by verifying that the user is a valid, approved user. If the user is not authenticated, the MFP may remain in a disabled state. Once authentication 286 has been successfully completed, the external accounting RCD 134, may send a successful authentication message 288 to the MFP 132, which may be displayed to the user 130. When the MFP 132 receives a successful authentication confirmation 288, the MFP 132 may create a job ID 290.

The job must be authorized before execution so the MFP 132 may send 292 job configuration data to external accounting RCD 134 for authorization. In some embodiments of the present invention, authorization 296 may comprise account management wherein the fees associated with the job description are compared to a user account status to verify that sufficient funds are available, sufficient credit is authorized or some other status. If the account status is acceptable for the specific job identified in the job description/ID, the job may be authorized and an authorization message 294 may be sent to the MFP 132 to authorize the job within the limits of the account status. Job limits may comprise a number of copies or iterations of a job that are allowed by the account status. In some embodiments, a counter may count down from the authorized limit until it reaches zero. At this point, the job authorization will be terminated and the job execution will stop. If the account status is not acceptable, the job may not be authorized and the user may be prompted to change the account status or modify the job description.

When a job is authorized and the authorization message 294 is received, the MFP 132 may then proceed to configure itself 298 for the job and execute 300 the job. The RCD2 136 application may request a job completion status 302 to determine when the job has been fully executed.

After job completion, a job completion event message 304 may be sent to the external accounting RCD 134. This message may inform the RCD 134 that the job is complete and may trigger accounting functions that debit, use credit or otherwise account for the job completion in the user's account. In addition to informing the RCD that the job is complete, the completion event message 176 may provide additional information about the job so that the RCD 134 may determine how to charge an account. After a job is complete, a user 130 may manually log out 178 to disable further use of the user's account or the account may be disabled automatically, such as a log out after a specified timeout period. When a user logs out, either manually or through an automated process, a login UI may be automatically displayed on the MFP 132.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

We claim:

1. A method for peripheral device accounting, said method comprising:

a) transmitting user identification (ID) menu content to a peripheral device from a remote computing device (RCD), wherein said peripheral device comprises a restricted function that is not accessible without restricted function menu content stored on said RCD;

b) displaying said user ID menu content at said peripheral device;

c) accepting a user ID code at said peripheral device;

d) transmitting said user ID code from said peripheral device to said RCD;

e) using said user ID code to validate a user with said RCD;

f) transmitting restricted function menu content from said RCD to said peripheral device, displaying said restricted function menu content at said peripheral device and enabling functional parameter input for said restricted function at said peripheral device when said user ID code is validated;

g) accepting a peripheral job configuration defined by said functional parameter input at said peripheral device;

h) transmitting said peripheral job configuration from said peripheral device to said RCD;

i) checking a user account to verify a user account status at said RCD;

j) enabling said peripheral device to execute said job configuration when said user account status is positive;

k) executing said job configuration at said peripheral device; and l) reporting a job execution status to said RCD, wherein said job execution status report enables said RCD to update said user account status when said job configuration is successfully completed.

2. A method as described in claim 1 wherein said validation of a user with said RCD comprises authentication of said user with a security system remote to said RCD.

3. A method for peripheral device accounting, said method comprising:

a) transmitting user identification (ID) menu content to a peripheral device from a remote computing device (RCD), wherein said peripheral device comprises a restricted function that is not accessible without restricted function menu content stored on said RCD;

b) displaying said user ID menu content at said peripheral device;

c) accepting a user ID code at said peripheral device;

d) transmitting said user ID code from said peripheral device to said RCD;

e) using said user ID code to validate a user with said RCD;

f) transmitting restricted function menu content from said RCD to said peripheral device, displaying said restricted function menu content at said peripheral device and enabling functional parameter input for said restricted function at said peripheral device via said restricted function menu content when said user ID code is validated;

g) accepting a peripheral job configuration defined by said functional parameter input at said peripheral device;

h) transmitting said peripheral job configuration from said peripheral device to a second RCD (RCD2);

i) transmitting a job ID request from said RCD2 to said peripheral device;

j) checking a user account to verify a user account status at said RCD;

k) enabling said peripheral device to execute said job configuration when said user account status is positive;

l) executing said job configuration at said peripheral device; and m) reporting a job execution status to said RCD, wherein said job execution status report enables said RCD to update said user account status when said job configuration is successfully completed.

* * * * *